US005374775A

United States Patent [19]

Kawamura et al.

[11] Patent Number: 5,374,775

[45] Date of Patent: Dec. 20, 1994

[54] KEYBOARD INSTRUMENT FOR SELECTIVELY PRODUCING MECHANICAL SOUNDS AND SYNTHETIC SOUNDS WITHOUT ANY MECHANICAL VIBRATIONS ON MUSIC WIRES

[75] Inventors: Kiyoshi Kawamura; Shinya Koseki; Nobuo Sugiyama; Masahiro Wada, all of Shizuoka, Japan

[73] Assignee: Yamaha Corporation, Hamamatsu, Japan

[21] Appl. No.: 73,092

[22] Filed: Jun. 7, 1993

[30] Foreign Application Priority Data

| | | | |
|---|---|---|---|
| Jun. 9, 1992 | [JP] | Japan | 4-174813 |
| Jul. 10, 1992 | [JP] | Japan | 4-207352 |
| Oct. 12, 1992 | [JP] | Japan | 4-299234 |
| Jan. 27, 1993 | [JP] | Japan | 5-031420 |

[51] Int. Cl.[5] ..... G10H 7/00; G10H 1/18

[52] U.S. Cl. ..... 84/615; 84/236; 84/243; 84/170; 84/171

[58] Field of Search ..... 84/615, 658, 220, 216, 84/236, 237, 238, 239, 240, 243, 33, 170, 171

[56] References Cited

U.S. PATENT DOCUMENTS

| | | | |
|---|---|---|---|
| 2,250,065 | 12/1940 | Koehl . | |
| 4,633,753 | 1/1987 | Takahashi | 84/220 |
| 4,704,931 | 11/1987 | Nagai et al. | 84/171 |
| 4,744,281 | 5/1988 | Isozaki | 84/171 |
| 4,970,929 | 11/1990 | Ishida | 84/220 |
| 5,115,705 | 5/1992 | Monte et al. | 84/658 |
| 5,247,129 | 9/1993 | Nozaki et al. | 84/615 |

FOREIGN PATENT DOCUMENTS

| | | |
|---|---|---|
| 44782 | 2/1888 | Germany . |
| 68406 | 11/1890 | Germany . |
| 97885 | 10/1897 | Germany . |
| 3707591 | 5/1988 | Germany . |
| 3707591C1 | 5/1988 | Germany . |
| TO9-1U000077 | 10/0892 | Italy . |
| 51-67732 | 5/1976 | Japan . |
| 55-55880 | 4/1980 | Japan . |
| 62-32308 | 8/1987 | Japan . |
| 63-97997 | 4/1988 | Japan . |
| 614303 | 11/1979 | Switzerland . |

*Primary Examiner*—William M. Shoop, Jr.
*Assistant Examiner*—Jeffrey W. Donels
*Attorney, Agent, or Firm*—Graham & James

[57] ABSTRACT

In order to give piano-like key touch to a player in an electronically sound producing mode, a keyboard incorporated in a musical instrument is linked with key action mechanisms associated with hammer mechanisms, and a stopper blocks the hammer shanks before the hammers strike the strings so that noises are not mixed with synthesized tones.

15 Claims, 20 Drawing Sheets

KEYBOARD INSTRUMENT FOR SELECTIVELY PRODUCING MECHANICAL SOUNDS AND SYNTHETIC SOUNDS WITHOUT ANY MECHANICAL VIBRATIONS ON MUSIC WIRES

FIELD OF THE INVENTION

This invention relates to a keyboard instrument and, more particularly, to a piano-like musical instrument for selectively producing acoustic sounds and synthesized sounds.

DESCRIPTION OF THE RELATED ART

The piano-like musical instrument is equipped with a keyboard coupled with key action mechanisms for piano key-touch, and an electric sound generator synthesizes sounds corresponding to the sounds produced through striking strings. However, when the key action mechanism causes a hammer to strike the strings, the strings vibrate, and the sound thus mechanically produced is mixed with the synthesized sound. An audience feels the mixed sounds strange. The keyboard instrument disclosed in Japanese Patent Publication (Kokoku) No. 1-30155 aims to decreasing the loudness of the acoustic sounds by contacting a damper mechanism with the strings. This approach is to restrict vibrations of the strings, and gives rise to decrease of the loudness of acoustic sounds.

A muting mechanism incorporated in a grand piano is disclosed in Japanese Utility Model Application laid-open No. 51-67732, and the muting mechanism restricts a hammer motion with a resilient member. The hammer concurrently strikes the resilient member and the associated strings so that the sound is lessened. The approach is to lessen force exerted on the strings. However, the muting mechanism is applied to a grand piano only, and gives rise to decrease of loudness of acoustic sounds.

Thus, the prior art keyboard instrument decreases acoustic sounds produced through striking strings. However, the prior art keyboard instrument can not perfectly eliminate the acoustic sounds from electrically synthesized sounds. If, on the other hand, the hammer is removed from the keyboard instrument, key action mechanisms become too light to give appropriate piano key-touch to a player, and the hammers are indispensable to the keyboard instrument.

SUMMARY OF THE INVENTION

It is therefore an important object of the present invention to provide a keyboard instrument which perfectly eliminates mechanical sounds from electrically produced sounds.

To accomplish the object, the present invention proposes to cause hammer shanks to be brought into contact with a stopper before hammers strike strings.

In accordance with one aspect of the present invention, there is provided a keyboard instrument selectively entering a mechanical sound producing mode and an electronic sound producing mode, comprising: a) an acoustic piano including a-1 ) a keyboard having a plurality of keys turnable with respect to a stationary board member, the plurality of keys being selectively depressed in both mechanical and electronic sound producing modes by a player, a-2) a plurality of key action mechanisms respectively coupled with the plurality of keys, and selectively actuated by the plurality of keys when the player depresses, a-3) a plurality of hammer mechanisms respectively associated with the plurality of key action mechanisms, and having respective hammers and hammer shanks respectively coupled with the hammers and driven for rotation by the plurality of key action mechanisms when the player selectively depresses the plurality of keys, and a-4) a plurality of strings associated with the plurality of hammer mechanisms, and struck by the hammers in the mechanical sound producing mode when the player selectively depresses the plurality of keys; b) an electronic sound producing means monitoring the plurality of keys to see what keys are depressed by the player in the electronic sound producing mode, and operative to electronically produce sounds corresponding to the keys depressed by the player; and c) a controlling means having a stopper located between the hammer shanks and the plurality of strings, and a driver unit for driving the stopper between a free position and a blocking position and responsive to an instruction of the player for changing the position of the stopper, the hammers freely striking the strings without any interruption with the stopper while the stopper is staying in the free position, the hammer shanks being brought into contact with the stopper in the blocking position so that the hammers are blocked before striking the plurality of strings.

In accordance with another aspect of the present invention, there is provided a piano comprising a) at least one key swingable with respect to a key bed; b) a key action mechanism including b-1) a whippen assembly driven by the key and having a whippen heel functionally coupled with the key, a whippen fixed to the whippen heel and rotatably supported by a whippen flange fixed to a first center rail stationary with respect to the key bed, a jack flange fixed to the whippen, a jack rotatably supported by the jack flange, a jack spring coupled between the whippen and the jack for urging the jack in a direction to decrease a distance therebetween, and b-2) a regulating button assembly supported by a second center rail and spaced from the jack for restricting a rotation of the jack; c) a hammer mechanism including c-1) a butt rotatably supported by a butt flange fixed to the first center rail, and driven for rotation by the jack at a low speed before the jack is brought into contact with the regulating button assembly, the butt being kicked by the jack for rotation at a high speed when the jack is brought into contact with the regulating button assembly, c-2) a hammer shank projecting from the butt, and c-3) a hammer head fixed to the hammer shank; d) a string spaced apart from the hammer head while the key is kept in a rest position, the string being struck by the hammer head when the key is depressed; e) a stopper located between the hammer mechanism and the string, and movable between a free position and a blocking position, the hammer shank being brought into contact with the stopper in the blocking position before the hammer head strikes the string, the stopper in the free position allowing the hammer head to strike the string without contact with the hammer shank; and f) a gap regulating means coupled with the second center rail, and allowing the second center rail to move with respect to the first center rail so as to change a gap between the regulating button assembly and the jack.

BRIEF DESCRIPTION OF THE DRAWINGS

The features and advantages of the keyboard instrument according to the present invention will be more clearly understood from the following description taken in conjunction with the accompanying drawings in which.

DESCRIPTION OF THE PREFERRED EMBODIMENTS

First Embodiment

Figure 1:
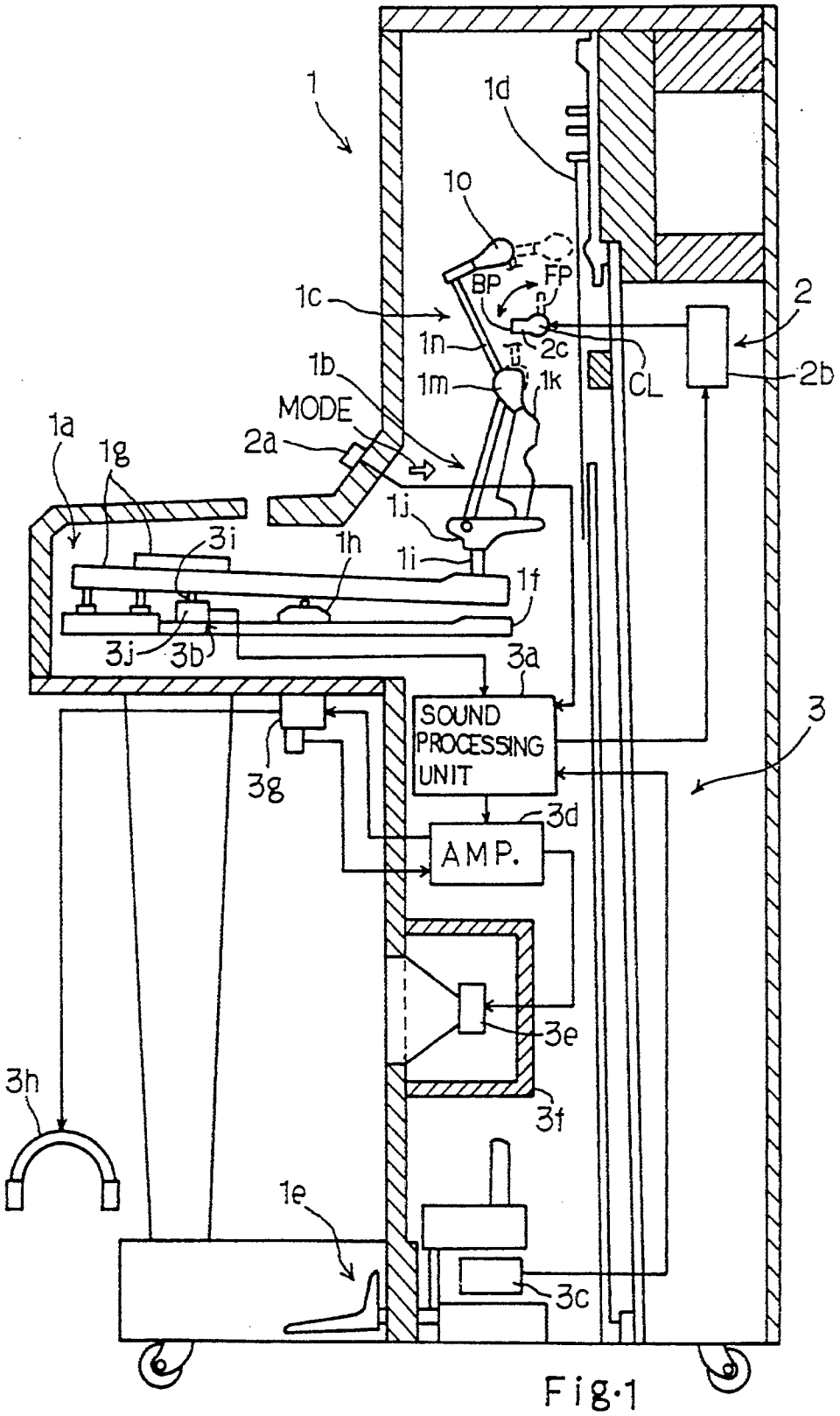
FIG.1 is a cross sectional view showing the structure of a keyboard instrument according to the present invention.

Referring first to FIG. 1 of the drawings, a keyboard instrument embodying the present invention largely comprises an acoustic piano 1, a controlling system 2 and an electronic sound generating system 3, and selectively enters a mechanical sound producing mode and an electronic sound producing mode. While in the mechanical sound producing mode, the keyboard instrument serves as an acoustic upright piano, and not only the sounds but also an key-touch are identical with those of in the electronic sound producing mode the acoustic upright piano. On the other hand, the keyboard instrument electrically synthesizes sounds in response to keying-in, and the acoustic sounds are not produced. In this instance, the acoustic piano 1 is of the upright type. However, the acoustic piano 1 may be of a grand type.

The acoustic piano 1 comprises a keyboard 1*a*, a plurality of key action mechanisms 1*b*, a plurality of hammer mechanisms 1*c*, a plurality sets of strings 1*d* and a pedal mechanism 1*e*. The keyboard 1*a* is mounted on a key bed 1*f*, and is fabricated from black and white keys 1*g*. In this instance, the key bed 1*f* serves as a stationary board member. The black and white keys 1*g*, are turnable with respect to balance pins embedded in a balance rail 1*h*. The key action mechanisms 1*b* are respectively linked with the rear ends of the black and white keys 1*g*, and drive the hammer mechanisms 1*c* for rotation when the associated keys 1*g* are depressed.

Each of the key action mechanisms 1*b* comprises a capstan button 1*i* projecting from the rear end of the associated key, an whippen 1*j* held in contact with the capstan button 1*i* and a jack 1*k* provided on the whippen 1*j*, and the jack 1*k* exerts a force on the associated hammer mechanism.

Each of the hammer mechanisms 1*c* comprises a butt 1*m* kicked by the jack 1*k*, a hammer shank 1*n* implanted in the butt 1*m* and a hammer 1*o* coupled with the leading end of the hammer shank 1*n*. When the jack 1*k* kicks the butt 1*m*, the butt 1*m* and, accordingly, the hammer 1*o* are driven for rotation toward the associated strings 1*d*, and the hammer 1*o* strikes the strings 1*d* so that the strings vibrate for producing an acoustic sound.

The pedal mechanism 1*e* usually has three pedals and three pedal link sub-mechanisms respectively associated with the pedals. One of the pedals is called a damper pedal, and allows the strings to prolong the sound. The second pedal is called a soft pedal, and causes the hammers to strike fewer than the normal number of strings for lessening the volume. The last pedal is called a sostenuto pedal, and enables selected notes to be sustained independently from the others.

The key action mechanisms 1*b*, the hammer mechanisms 1*c* and the pedal mechanism 1*e* are well known to a person skilled in the art, and no further description is necessary.

The controlling system 2 comprises a sound processing unit 3*a*, a mode shift switch 2*a*, a motor driver unit 2*b* and a rotatable stopper 2*c*. The mode shift switch 2*a* is manipulated by a player, and produces an instruction signal MODE indicative of either mechanical or electronic sound producing mode. The sound processing unit 3*a* periodically checks an input port assigned to the instruction signal MODE to see whether or not the player changes the operation mode. While staying in the mechanical sound producing mode, the sound processing unit 3*a* instructs the motor driver unit 2*b* to keep the stopper 2*c* in a free position FP where the hammer 1*o* can strike the associated strings 1*d* without interruption of the stopper 2*c*. On the other hand, if the instruction signal MODE is indicative of the electronic sound producing mode, the sound processing unit 3*a* instructs the motor driver 2*b* to change the stopper 2*c* from the free position FP to a blocking position BP, and the stopper 2*c* blocks the hammer 1*o* before striking the strings 1*d*.

The stopper 2*c* is located in the vicinity of the strings 1*d*, and is closer to the butts 1*m* rather than the hammers 1*o*. This location of the stopper 2*c* is desirable, because the stopper 2*c* allows the hammer shanks 1*n* to be resiliently deformed. Such a resilient deformation gives a piano-like key-touch to the player.

When the stopper 2*c* is moved to the blocking position BP, the rotational axis CL of the stopper 2*c* is substantially aligned with a line of action for each of the hammer shanks 1*n*, and no moment is not exerted on the stopper 2*c*. For this reason, large mechanical strength is not necessary for the stopper 2*c*, and the stopper 2*c* can be designed to be small enough to occupy a small amount of space between the hammer mechanisms 1*c* and the strings 1*d*.

Figure 2:
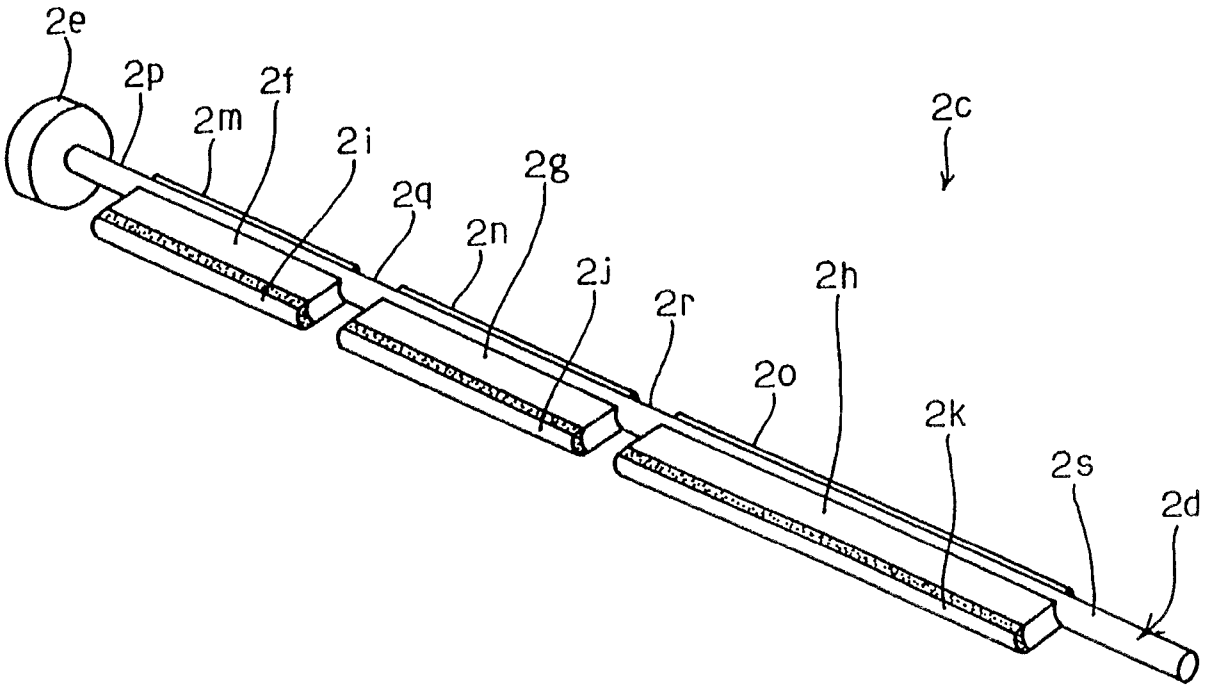
FIG. 2 is a perspective view showing the structure of a stopper incorporated in the keyboard instrument.

Turning to FIG. 2 of the drawings, the stopper is illustrated in an enlarged scale, and comprises a shaft member 2*d* of either steel, aluminum or plastic, a motor unit 2*e*, three bracket members 2*f*, 2*g* and 2*h*, three cushion members 2*i*, 2*j* and 2*k* and three cushion sheets 2*m*, 2*n* and 2*o*. The shaft member 2*d* extends in a lateral direction along the array of the hammer mechanisms 1*c*, and has a center axis substantially aligned with a drive shaft (not shown) of the motor unit 2*e*. The motor unit 2*e* is bidirectionally rotatable , and the drive shaft is coupled with the shaft member 2*d*. The motor unit 2*e* is a stepping motor, and drives the shaft member in both clockwise and counter clockwise directions. Alternatively, the motor unit 2*e* may be an ultrasonic motor. The ultrasonic motor can maintain the shaft at any position without current, and quietly rotates at a low speed without any backlash. These features are desirable for a musical instrument.

Though not shown in the drawings, the shaft member 2*d* is rotatably supported at four points 2*p*, 2*q*, 2*r* and 2*s* by action brackets for low-pitched sounds, section plates for low, middle and high pitched sounds and action brackets for high-pitched sounds, and the action brackets and the section plates are connected at upper end portions thereof with a pin block by means of action bolts and at the lower end portions thereof with the key bed 1*f* through bracket blocks. However, any stationary component members of the piano 1 may be available to support the shaft member 2*d*.

The three bracket members 2*f* to 2*h* are attached to the shaft member 2*d* at intervals, and the three bracket members 2*f* to 2*h* respectively support the three cushion members 2*i* to 2*k*. The cushion members 2*i* to 2*k* are formed of felt or urethane, and the striking surfaces of the cushion members 2*i* to 2*k* may be covered with artificial leather for prolonged service life. The three cushion sheets 2*m*, to 2*o* are similarly formed of felt or urethane, and are bonded to the shaft member 2*d* at the opposite side to the bracket members 2*f* to 2*h*. However, various resilient members are available for the cushion members 2*i* to 2*k* as well as the cushion sheets 2*m*, to 2*o*. The total height of each bracket member 2*f*, 2*g* or 2*h* and the cushion member 2*i*, 2*j* or 2*k* is large enough to prevent the strings 1*d* from being struck with the hammers 1*o*.

Figure 3:
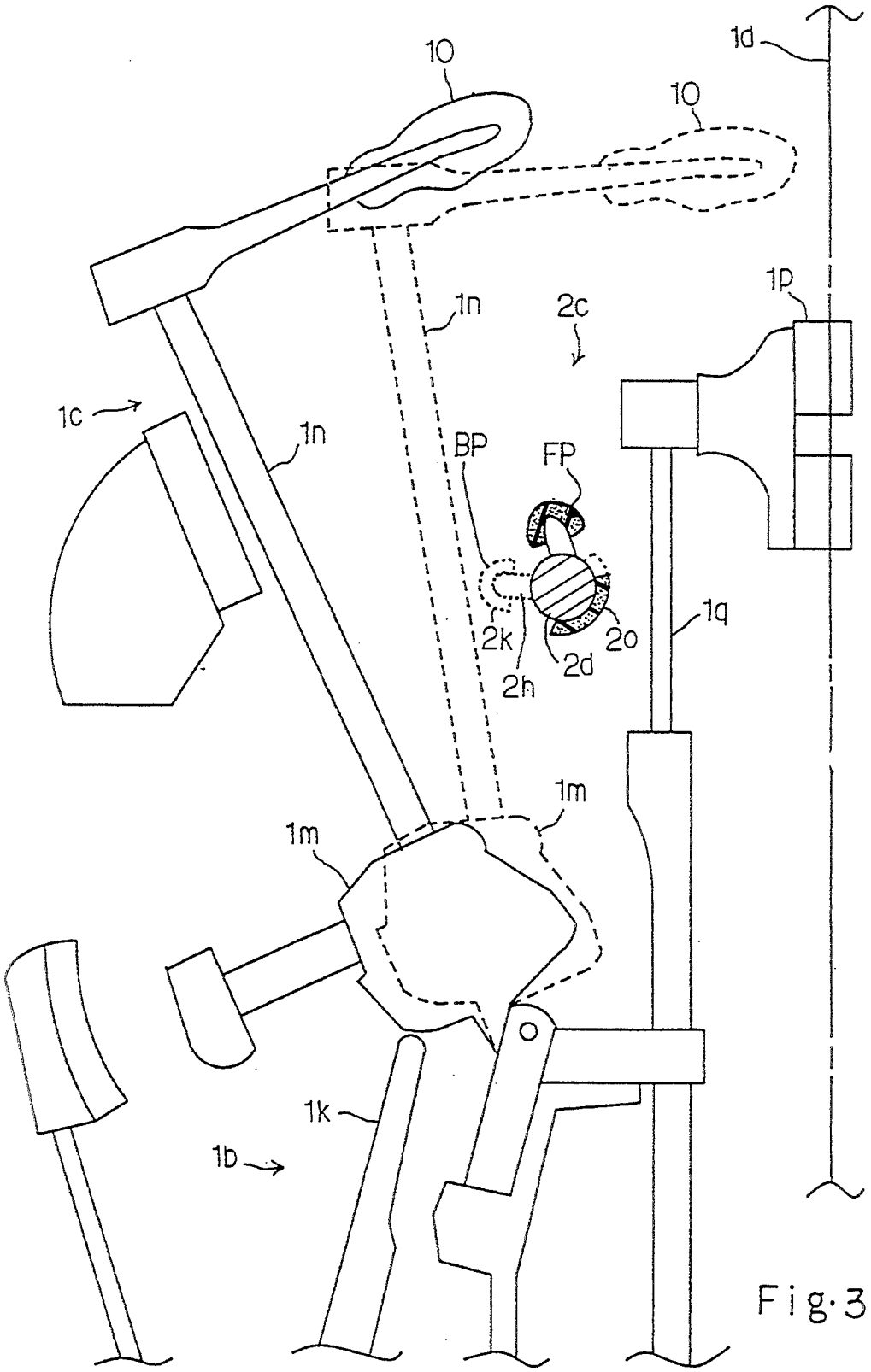
FIG. 3 is a side view showing a hammer mechanism and the stopper.

While the stopper 2*c* is in the blocking position BP, the three cushion members 2*i* to 2*k* are directed to the hammer shanks 1*n* as shown in FIG. 3, and the hammer shanks 1*n* softly impact on the cushion members 2*f* to 2*k* or on the leather sheets bonded thereto upon depressing the associated keys 1*g*. The hammer shanks 1*n* limit the motions of the hammers 1*o*, and the hammers 1*o* stop the motions before striking the associated strings 1*d*. Thus, the cushion members 2*f* to 2*h* effectively eliminate noises, and do not allow the strings 1*d* to produce any sound. However, the key action mechanisms 1*b* and the hammer mechanisms 1*c* give a desirable piano-touch to the player. When the player depresses one of the keys 1*g*, the associated key action mechanism 1*b* allows a damper 1*p* to separate from the associated strings 1*d*, and a damper wire 1*q* is brought into contact with one of the cushion sheets 2*m*, to 2*o*. The cushion sheet takes up the force, and eliminates noises.

If the player instructs the keyboard instrument to perform a music in the mechanical sound producing mode, the motor unit 2*e* drives the shaft member 2*d* for rotation in the clock-wise direction, and the cushion sheets 2*m* to 2*o* face the hammer shanks 1*n*. As described hereinbefore, the cushion sheets 2*m*, to 2*o* in the free position FP are low enough to allow the hammers 1*o* to strike the strings 1*d*.

The gap between the hammer shanks 1*n* and the cushion members 2*i* to 2*k* is gradually increased from the blocking position BP and the free position FP. Therefore, if the stopper is moved to an intermediate position between the blocking position BP and the free position FP, the hammer shanks 1*n* allows the hammers 1*o* to softly strike the strings 1*d*, and the stopper 2*c* lessens the 1*o* loudness of sounds. The intermediate position is hereinbelow called as a mute sub-mode, and the mechanical sound producing mode has a mute sub-mode and an ordinary sub-mode where the hammers 1*o* fully strike the associated strings 1*d* without any interrupt by the stopper 2*c*.

The electronic sound generating system 3 comprises the sound processing unit 3*a*, a plurality of key sensors 3*b*, a plurality of pedal sensors 3*c*, an amplifier unit 3*d*, a speaker system 3*e* housed in a speaker box 3*f*, a socket unit 3*g* and a headphone 3*h* detachable from the socket unit 3*g*, and is activated in the electronic sound producing mode. In this instance, the data memories 3*m* and 3*o* are implemented by non-volatile memory devices such as, for example , read only memory devices, and random access memory devices serve as the working memory 3*r*.

The plurality of key sensors 3*b*, is respectively associated with the plurality of keys 1*g*, and each of the key sensors 3*b*, comprises a shutter plate 3*i* fixed to the bottom surface of the associated key and a photo-interrupter 3*j* monitoring the shutter plate 3*i*. Four different patterns are formed in the shutter plate 3*i*, and the four patterns sequentially passes through an optical path produced by the photo interrupter 3*j* when the associated key is depressed. Time intervals between the four patterns are reported from the photo interrupter 3*j* to the sound processing unit 3*a*, and the sound processing unit 3*a* determines the key velocity and estimates the time when the associated hammer strikes the strings.

The pedal sensors 3c monitor the three pedals to see whether or not the player steps on any one of the three pedals. If the player steps on one of the pedals, the pedal sensors 3c detect the motion of the pedal, and report the pedal manipulated by the player to the sound processing unit 3a.

Figure 4:
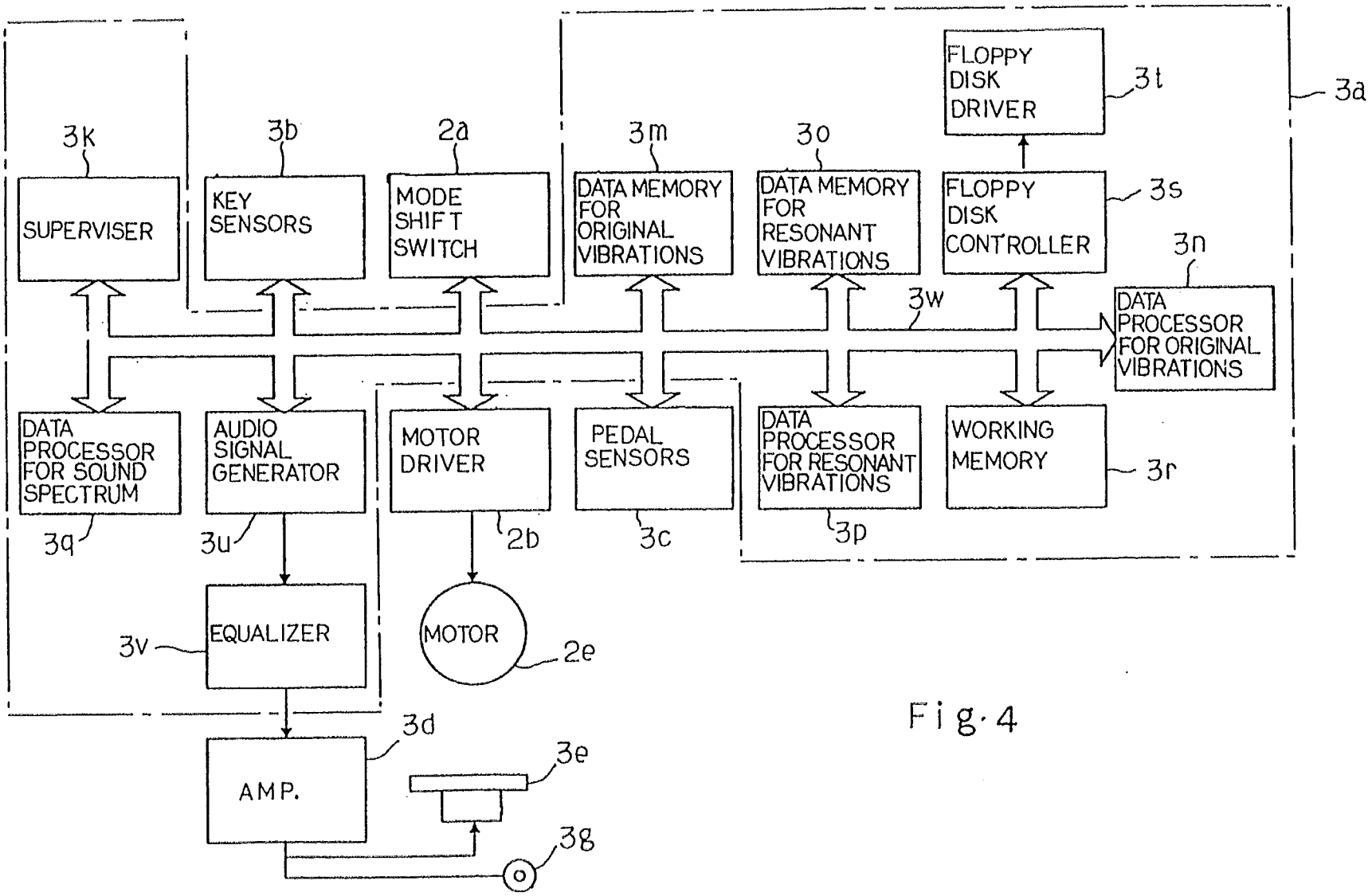
FIG. 4 is a block diagram showing the arrangement of a data processing unit incorporated in the keyboard instrument.

The sound processing unit 3a is arranged as shown in FIG. 4 of the drawings, and comprises a supervisor 3k, a data memory for original vibrations 3m, a data processor for original vibrations 3n, a data memory for resonant vibrations 3o, a data processor for resonant vibrations 3p, a data processor for sound spectrum 3q, a working memory 3r, a floppy disk controller 3s, a floppy disk driver 3t, an audio signal generator 3u, an equalizer 3v and a bus system 3w.

The supervisor 3k sequentially scans signal input ports assigned to the mode control signal MODE, the detecting signals from the key sensors 2b and the detecting signals from the pedal sensors 2c, and supervises the other components 3m to 3u for producing an audio signal. An internal table is incorporated in the supervisor 3k, and the internal table defines relation between the key numbers, key velocity and timings for producing the audio signal. The audio signal is supplied from the equalizer 3v to the amplifier unit 3d, and the audio signal is distributed to the speaker system 3e and the socket unit 3g for producing synthesized sounds. Various internal registers are incorporated in the supervisor 3k, and one of the internal registers is assigned to a mode flag indicative of the mode operation selected by the player.

The data memory 3m for original vibrations stores a plurality sets of pcm (Pulse Code Modulation ) data codes indicative of frequency spectrum of original vibrations of the strings 1d, and each set of pcm data codes is corresponding to one of the keys 1g. A plurality groups of pcm data codes form a set of pcm data codes, and are corresponding to frequency spectrums at different intensities or hammer speeds. In general, if a hammer 1o strongly strikes the associated string 1d, higher harmonics are emphasized. The plurality sets of pcm data codes are produced with a sampler (not shown) through sampling actual vibrations on the respective strings 1d at an appropriate frequency. However, the set of pcm data codes may be produced by means of the data processor 3q through a real-time processing. Using a group of pcm data codes, original vibrations produced upon depressing a key 1g are restored, and the supervisor 3k controls the sequential access to a group of pcm data codes stored in the data memory 3m.

The data processor 3n for original vibrations is provided in association with the data memory 3m, and modifies a group of pcm data codes for an intermediate hammer speed. The modification with the data processor 3n is also controlled by the supervisor 3k.

The data memory for resonant vibrations 3o stores a plurality sets of pcm data codes indicative of resonant vibrations, and the resonant vibrations take place in response to stepping on the damper pedal. When the player steps on a damper pedal of a piano, dampers are held off, and some of the strings 1d are resonant with the string struck by an associated hammer. The resonant tones range between −10 dB and −20 dB with respect to the tone originally produced through striking with a hammer 1o, and time delay of several milliseconds to hundreds of milliseconds is introduced between the originally produced sound and the resonant tones. If the player continuously steps on the damper pedal, the resonant tones continue for several seconds. However, the player can rapidly terminate the original and resonant tones by releasing the damper pedal, and the audio signal generator 3u is responsive to the detecting signal of the pedal sensors 2c for the rapid termination. The pcm data codes stored in the data memory 3o are indicative of frequency spectrum of the resonant vibrations, and are also produced by means of the sampler or the data processor for resonant vibrations 3p. Each of the plurality of sets of pcm data codes corresponds to one of the depressed keys 1g, and is constituted by six groups of pcm data codes at the maximum. Each group of pcm data codes corresponds to one of the resonant strings 1d, and the second harmonic to the sixth harmonic are taken into account for strings one octave higher than low-pitched sounds. However, if the depressed key is higher than the thirteenth key from the lowest key in the eighty-eight keys, the string one octave lower than the depressed key should be taken into account. In general, seventy-one dampers are incorporated in a piano. However, another piano may have sixty-six dampers or sixty-nine dampers. As described hereinbefore, the intensity of frequency spectrum corresponds to the hammer speed. However, the intensities are variable with the type and model of the piano.

A set of pcm data codes are sequentially read out from the data memory 3o depending upon the depressed key 1g under the control of the supervisor 3k, and the data processor for resonant vibrations 3p modifies the pcm data codes for an intermediate intensity. The memory capacity of the data memory 3o may be large enough to store the pcm data codes at all of the detectable hammer speeds, and the data processor 3p may calculate each set of pcm data codes on the basis of parameters stored in the data memory 3o.

The data processor for sound spectrum 3q can produce a group of pcm data codes indicative of frequency spectrum for original vibrations and a set of pcm data codes indicative of frequency spectrum for resonant vibrations as described hereinbefore. The data processor 3q is further operative to cause the frequency spectrum to decay. In detail, when a player releases a key of a piano, original vibrations on a string rapidly decay, because an associated damper is brought into contact with the string. The data processor 3q simulates the decay, and sequentially decreases the values of the pcm data codes. The resonant tones continue for several seconds in so far as the player keeps the damper pedal in the depressed state. However, if the player releases the damper pedal, the resonant tones are rapidly decayed. The data processor 3q further simulates the decay, and sequentially decreases the values of the pcm data codes for the resonant vibrations.

The decay is not constant. If the player releases the damper pedal through a half pedal operation, the tones decay at lower speed rather than the ordinary release. Moreover, some players use the half pedal in such a manner as to retard low-pitched tones rather than high-pitched tones, and such a pedal manipulation is called an oblique contact. On the other hand, if the damper pedal causes all the dampers to be simultaneously brought into contact with the strings, the damper manipulation is referred to as simultaneous contact. The data processor 3q can simulate the gentle decay upon the release through the half pedal operation as well as the oblique contact, and the values of the pcm data codes are decreased at either high, standard or low speed in the simultaneous contact and at different speeds in the case of oblique contact. The data processor 3*q* may change the ratio between the fundamental tone and the harmonics thereof for half pedal operation and decay high-order harmonics faster than the fundamental tone. The frame of a piano usually vibrates, and the frame noises contribute to the piano tone. The data processor 3*q* may take these secondary noises into account and modify the frequency ratio.

The audio signal generator 3*u* comprises a digital filter, a digital-to-analog converter and a low-pass filter, and produces an analog audio signal from the pcm data codes supplied from the data memories 3*m* and 3*o* and/or the data processors 3*n*, 3*p* and 3*q*. The pcm data codes are subjected to a digital filtering, and are, then, converted into an analog audio signal. In the digital filtering, the vibration characteristics of the speaker system 3*e* and vibrative characteristics of the speaker box 3*f* are taken into account, and the pcm data codes are modified in such a manner that the frequency spectrum of produced sounds becomes flat. The digital filter is of the FIR type. However, an IIR type digital filter is available . An oversampling type digital filter may follow the digital filtering for eliminating quantization noises.

After the digital filtering, the digital-to-analog converter produces the analog audio signal, and the analog audio signal is filtered by the low-pass filter, which is of a Butterworth type for improving group delay. The analog audio signal thus filtered is supplied through the equalizer 3*v* to the amplifier unit 3*d*, and the amplifier unit 3*d* amplifies the analog audio signal for driving the speaker system 3*e*.

The floppy disk driver 3*t* reads out data codes formatted in accordance with the MIDI standards from a floppy disk under the control of the floppy disk controller 3*s*, and the superviser 3*k* allows the audio signal generator 3*u* to reproduce sounds from the data codes read out from the floppy disk. Therefore, a music can be reproduced in the timbre of another musical instrument such as, for example , a pipe organ, a harpsichord or a wind musical instrument.

The superviser 3*k* may format the detection signals of the key sensors 2*b* and the detection signals of the pedal sensors 2*c* in accordance with the MIDI standards, and the MIDI codes are stored in a floppy disk under the control of the floppy disk controller 3*s*. If the keyboard instrument can record a performance, the keyboard instrument has three modes of operation, i.e., the mechanical and electronic sound producing modes and the recording mode.

Figure 5A:
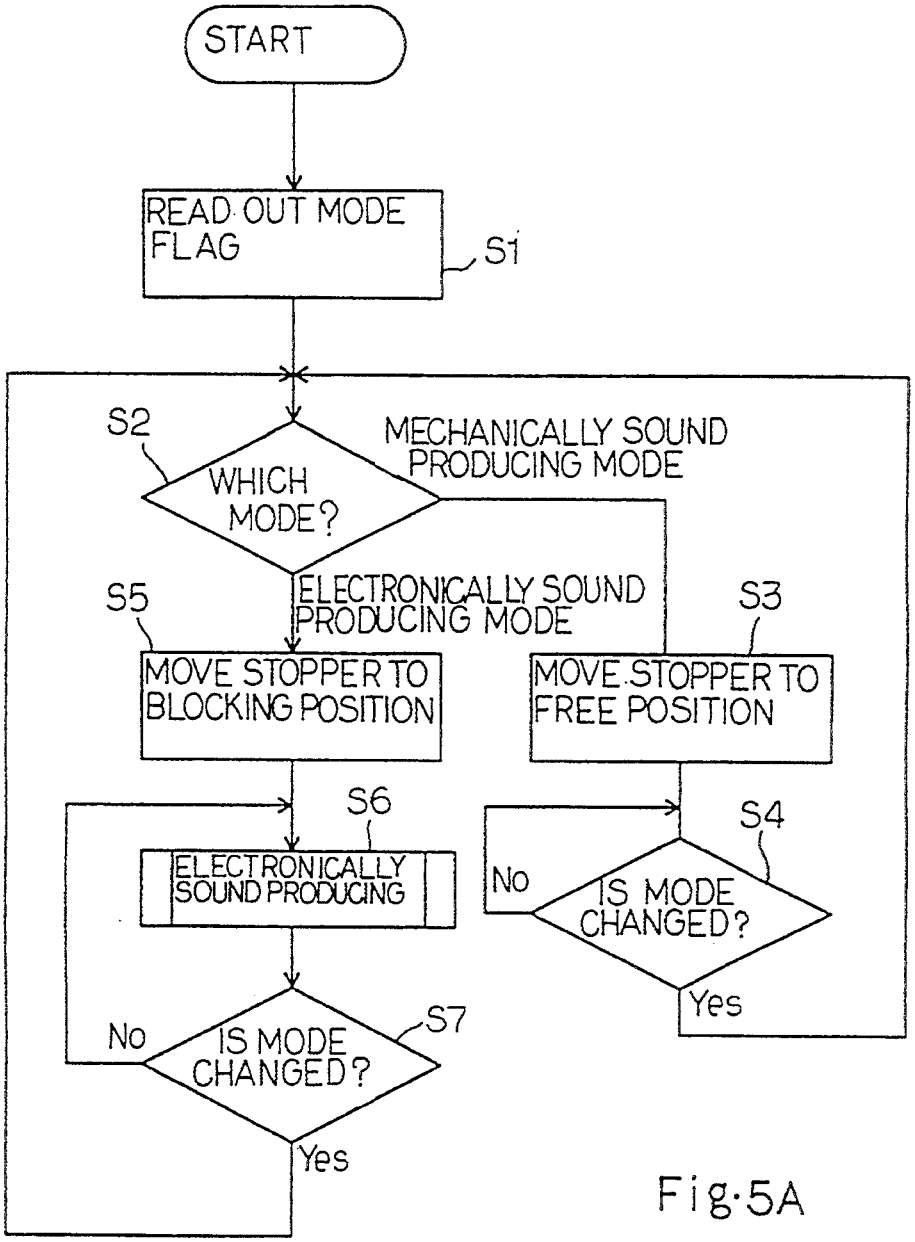
FIGS. 5A and 5B are flow charts showing a program sequence executed by a data processing unit incorporated in the keyboard instrument shown in FIG. 4.

The keyboard instrument thus arranged executes a program sequence illustrated in FIG. 5A. Namely, the superviser 3*k* reads out the mode flag from the internal register as by step S1, and checks the mode flag to see whether the player instructs the mechanical sound producing mode or the electronic sound producing mode as by step S2 . If the player has instructed the mechanical sound producing mode through the mode shift switch 2*a*, the superviser 3*k* proceeds to step 3, and instructs the motor driver 2*b* to change the stopper 2*c* to the free position FP. Then, the stopper 2*c* allows the hammers 1*o* to strike the associated strings 1*d* without any interrupt by the stopper 2*c*. After the stopper 2*c* thus moved to the free position FP, the player selectively depresses the black and white keys 1*g*, and the key action mechanisms 1*b* associated with the depressed keys drive the hammer mechanisms 1*c* for striking the strings.

While the player is performing in the mechanical sound producing mode, the superviser 3*k* periodically checks the input port assigned to the mode shift switch 2*a* to see whether or not the player changes the mode from the mechanical sound producing mode to the electronic sound producing mode as by step S4. If the answer to the step S4 is given negative, the superviser 3*k* repeats the step S4, and the player continues to perform the music.

However, if the player manipulates the mode shift switch 2*a*, the answer to the step S4 is given positive, and the superviser 3*k* returns to the step S2. The answer to the step S2 is indicative of the electronic sound producing mode, and the supervisor 3*k* rewrites the mode flag. Furthermore, the supervisor 3*k* instructs the motor driver 2*b* to change the stopper 2*c* to the blocking position BP as by step S5. Then, the cushion members 2*i* to 2*k* are directed to the hammer shanks 1*n*.

While the player is selectively depressing the black and white keys 1*g*, the sound processing unit 3*a* electronic synthesizes sounds through an electronically sound producing sub-routine S6 in cooperation with the key sensors 3*b*, the pedal sensors 3*c*, the amplifier 3*d* and the speaker system 3*d*. If the player hears the sounds with the headphone 3*h*, the synthesized sounds do not disturb other people, e.g.,those sleeping in bed. In the electronic sound producing mode, the key action mechanisms 1*b* also drive the hammer mechanisms 1*c*, and the key action mechanisms 1*b* and the hammer mechanisms 1*c* give the piano key-touch to the player. However, the hammer shanks 1*n* impacts on the cushion members 2*i* to 2*k*, and no noises are produced and mixed with the synthesized sounds.

Figure 5B:
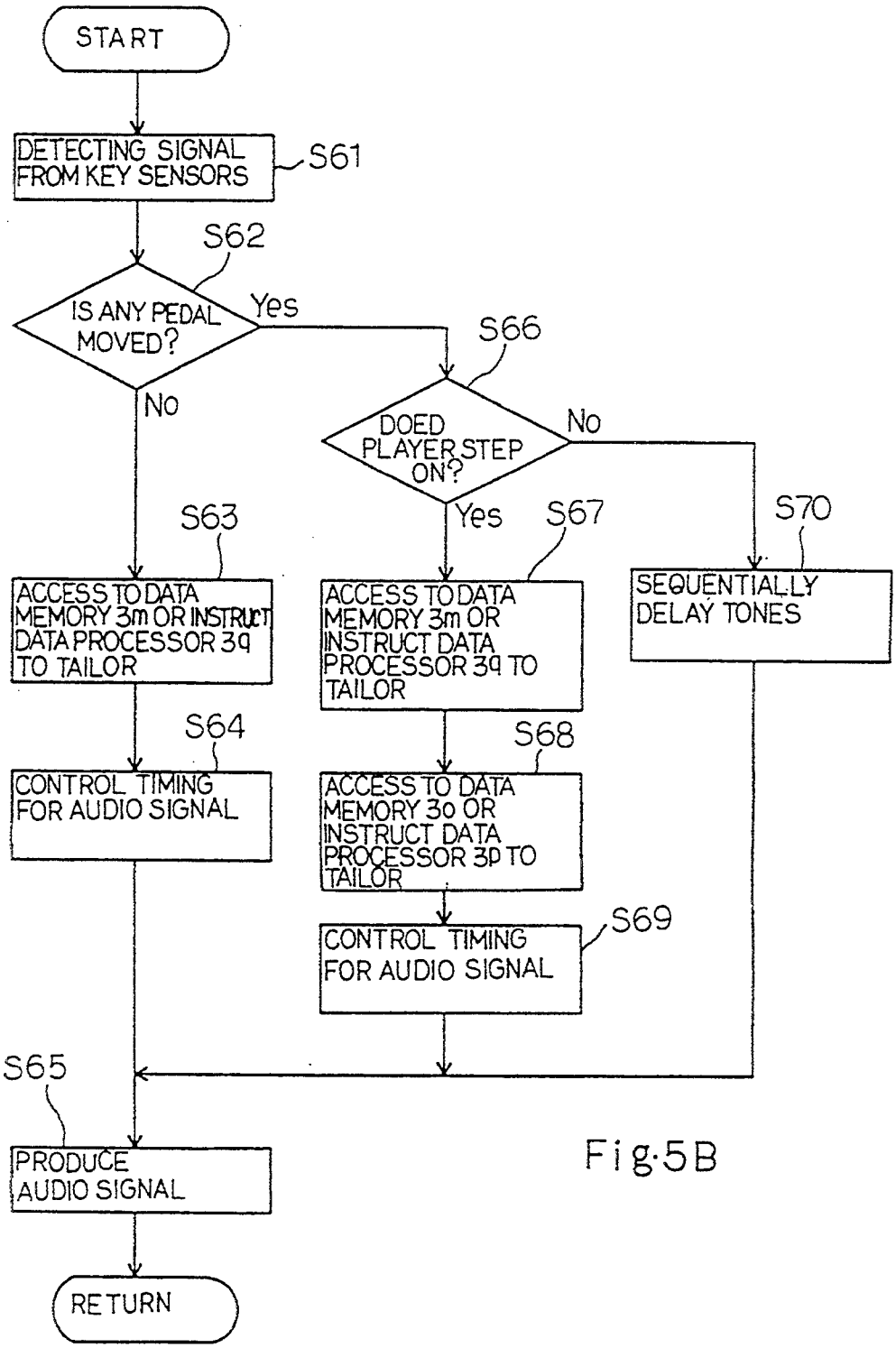

FIG. 5B illustrates the electronic sound producing sub-routine. Upon entry of the electronic sound producing sub-routine S6, the supervisor 3*k* monitors the input port assigned to the detection signals from the key sensors 3*b*, and receives the detection signal from the key sensors 3*b* as by step S61, if any. After the receipt of the detection signal, the supervisor 3*k* identifies the depressed key, and determines the key velocity on the basis of the detection signal. The supervisor 3*b* checks the input port assigned to the detection signals from the pedal sensors 3*c* to see whether or not one of the pedals is moved as by step S62. If the answer to the step S62 is given negative, the supervisor 3*k* accesses one of the groups of pcm data codes associated with the depressed key in the data memory 3*m* or instructs the data processor 3*q* to tailor a group of pcm data codes for the depressed key.

The supervisor 3*k* accesses the internal table thereof, and determines appropriate timing for producing the audio signal as by step S64. The supervisor 3*k* waits for the appropriate timing, and supplies the group of pcm data codes to the audio signal generator 3*u* for producing the audio signal as by step S65. Then, the audio signal is amplified by the amplifier 3*d*, and the speaker system 3*e* produces a synthesized sound corresponding to the depressed key. After the step S65, the supervisor 3*k* returns to the program sequence shown in FIG. 5A, and proceeds to steep S7 in FIG. 5A.

However, if one of the pedal such as the damper pedal is moved, the answer to the step S62 is given positive, and the supervisor 3*k* checks the detection signal from the pedal sensors 3*c* to see whether or not the pedal is pushed down as by step S66. If the player steps on the pedal, the answer to the step S66 is given positive, and the supervisor 3*k* accesses the pcm data codes in the data memory 3m or instruct the data processor 3q to tailor the pcm data codes as by step S67. The supervisor further accesses the pcm data codes in the data memory 3o or instructs the data processor 3p to tailor the pcm data codes as by step S68 so as to simulate the resonant vibrations on the related strings. The supervisor 3k controls the timing of the pcm data codes for the original vibrations and the timing of the pcm data codes for the resonant vibrations as by step S69, and time delay is introduced between the timing for the original vibrations and the timing for the resonant vibrations. Upon completion of the step S69, the supervisor 3k proceeds to the step S65.

On the other hand, if the pedal is upwardly moved to the rest position, the answer to the step S66 is given negative, and the supervisor 3k instructs the data processor 3q to sequentially decrease the values of the pcm data codes at a selected speed so as to decay the synthesized tone and the resonant tones as by step S70. Then, the supervisor 3k proceeds to the step S65.

Turning back to FIG. 5A, while the player is performing the music in the electronic sound producing mode, the supervisor 3k periodically checks the input port assigned to the mode shift switch 2a to see whether or not the mode is changed to the mechanically sound producing mode as by step S7. If the answer to the step S7 is given negative, the supervisor 3k returns to the step S6, and reiterates the loop consisting of the steps S6 and S7. However, if the answer to the step S7 is given positive, the supervisor 3k returns to the step S2 again.

Thus, the supervisor 3k sequentially executes the loop consisting of the steps S2 to S7, and the player performs the music in either sound producing mode.

As will be appreciated from the foregoing description, the keyboard instrument according to the present invention is equipped with a stopper 2c switched between the free position and the blocking position, and, for this reason, the player can enjoy a music without disturbing his family and neighborhood.

Second Embodiment

Figure 6:
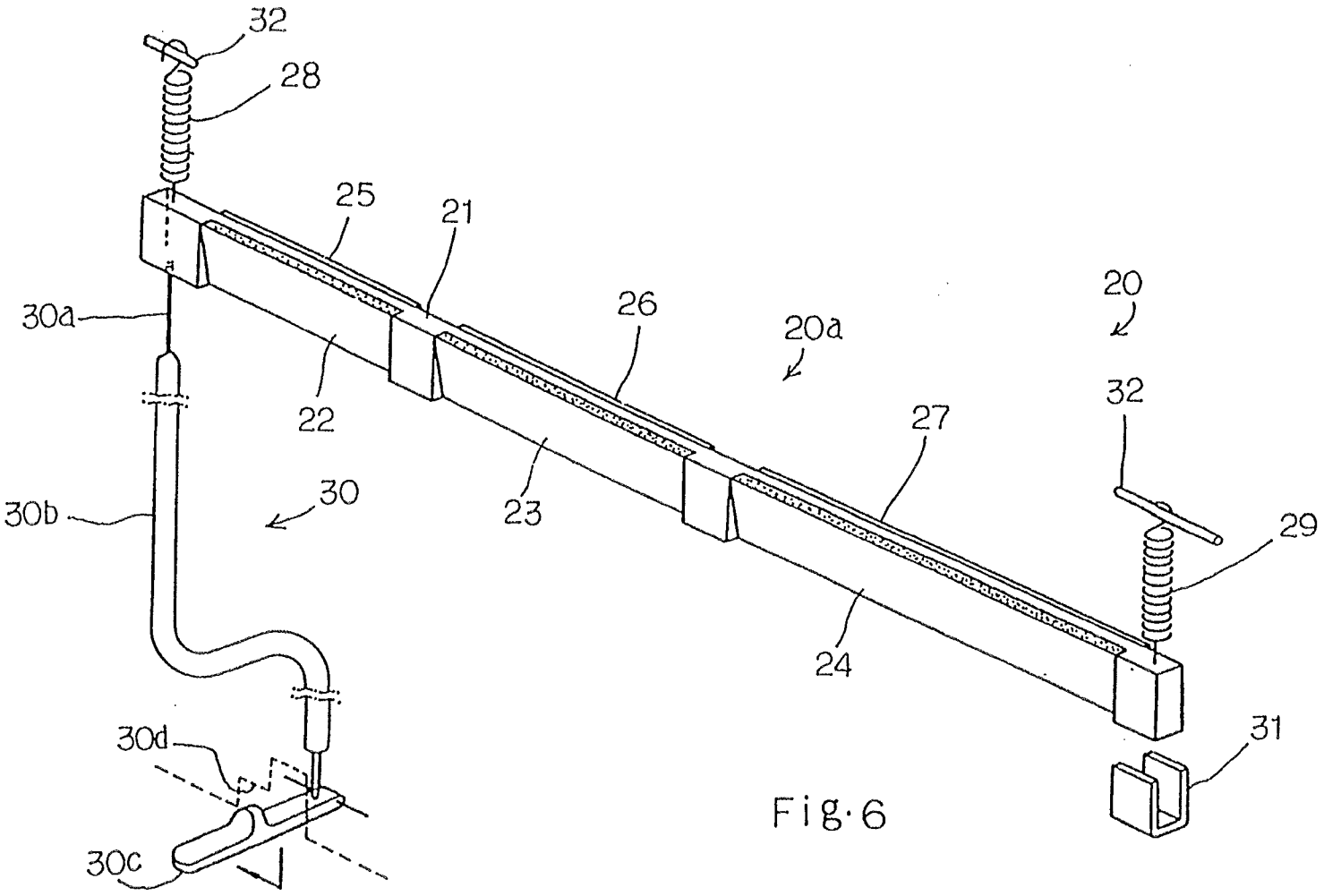
FIG. 6 is a perspective view showing a stopper incorporated in another keyboard instrument according to the present invention.

Turning to FIG. 6 of the drawings, a controlling mechanism 20 incorporated in another keyboard instrument embodying the present invention largely comprises a movable plate member 21, three cushion member 22 to 24, three cushion sheets 25 to 27, coil springs 28 and 29, a shifting mechanism 30 and a limiter 31, and the stopper 20a selectively enters a free position and a blocking position. The other components of the keyboard instrument are similar to those of the first embodiment, and no further description is incorporated hereinbelow for avoiding undesirable repetition. However, the other components are labeled with the same references as those of the first embodiment in the following description.

The plate member 21 is elongated in the lateral direction parallel to the array of hammer mechanisms 1c, and has generally rectangular configuration. The plate member 21 has oblique surfaces (see FIG. 7) at intervals, and the cushion members 25 to 27 are fixed to the oblique surfaces, respectively. The cushion sheets 22 to 24 are faced to the hammer shanks 1n, and the hammer shanks 1n softly impact on the cushion members 22 to 24 in the blocking position BP. The cushion sheets 25 to 27 are fixed to the opposite surfaces to the cushion members 22 to 24, and are faced to the damper wires 1q. When the stopper 20 is in the blocking position, the hammer shanks 1n and the damper wires 1q are brought into contact with the cushion members 22 to 24 and the cushion sheets 25 to 27.

The plate member 21 is suspended through the coil springs 28 and 29 by pin members 32 fixed to side boards (not shown), and the is pulled down by means of the shifting sub-mechanism 30. The shifting sub-mechanism 30 comprises a wire 30a coupled with the plate member 21, a pipe member 30b connected with the wire 30a, a pedal 30c coupled with the pipe member 30b and a step portion 30d formed in a bottom sill. If a player steps on the pedal 30c and leftwardly pushes the pedal 30c, the pedal 30c is engaged with the step portion 30b, and the shifting sub-mechanism 30 keeps the plate member 21 in the blocking position. The plate member 21 thus kept in the blocking position is inserted into the limiter 31, and the step portion 30b and the limiter 31 exactly define the blocking position.

Figure 7:
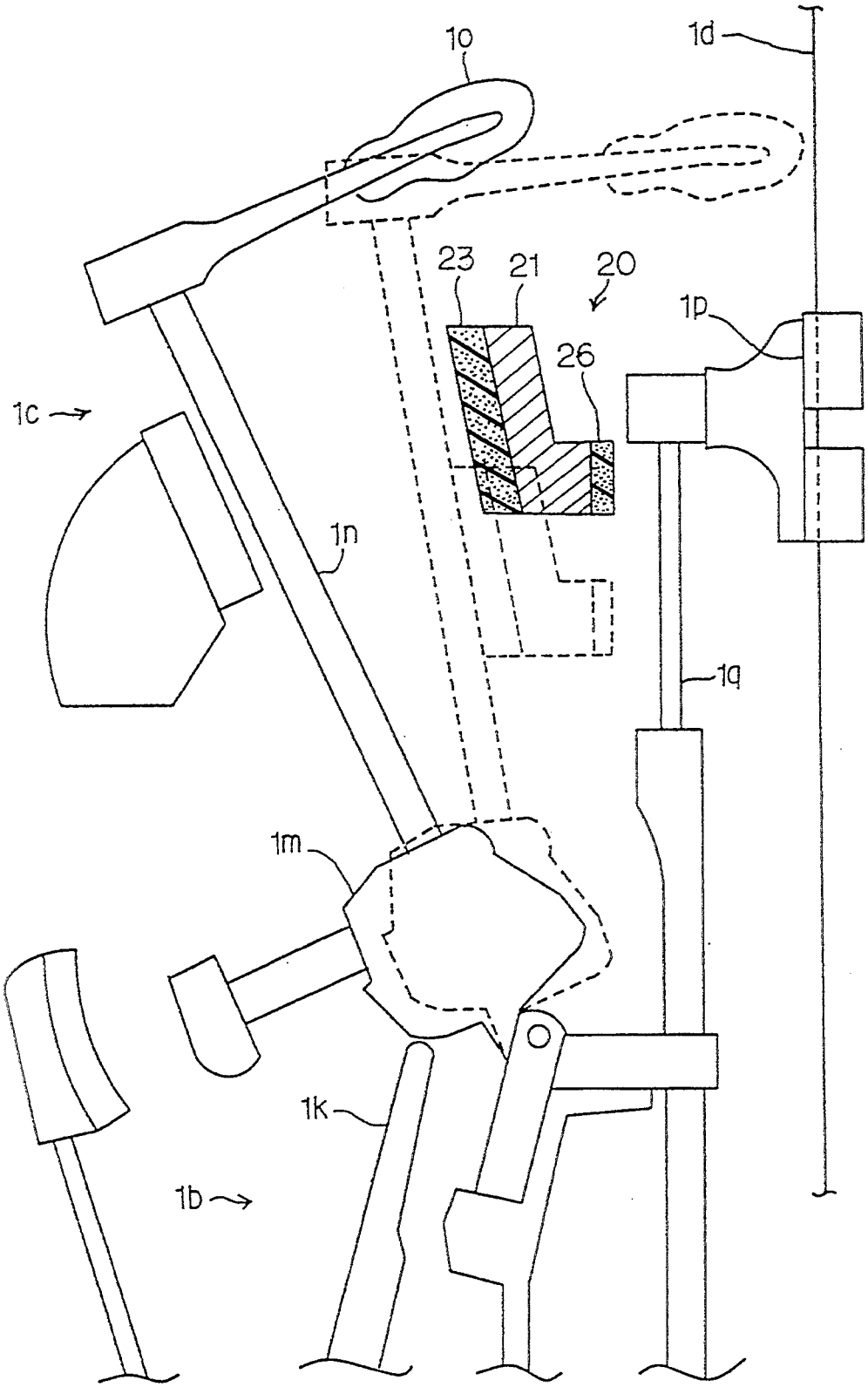
FIG. 7 is a side view showing the stopper and a hammer mechanisms incorporated in the keyboard instrument shown in FIG. 6.

As will be better seen from FIG. 7, when the stopper 20a is in the blocking position, the hammer shanks 1n can be brought into contact with the cushion members 22 to 25, and the strings 1d are not struck by the hammers 1o. Therefore, the strings 1o do not vibrate, and the electronic sound producing system 3 synthesizes sounds with notes assigned to the strings instead of the strings 1d.

However, if the pedal 30c is released from the step portion 30b, the coil springs 28 and 29 pull up the plate member 21, and the stopper 20a enters the free position. In the free position, the hammers 1o strike the strings before the hammer shanks 1n are brought into engagement with the cushion members 22 to 24. For this reason, the strings 1d vibrate at respective pitches, and produce the acoustic sounds.

In this instance, the pedal 30c is changed between two positions. However, if another step is formed between the two positions, the stopper 20a can be kept at an intermediate position between the free position and the blocking position, and the mechanically sound producing mode has two sub-modes, i.e., the mute sub-mode and the ordinary sub-mode. Thus, the keyboard instrument implementing the second embodiment can perfectly eliminate noises in the electronic sound producing mode.

Third Embodiment

A keyboard instrument implementing the third embodiment selectively enters the mechanical sound producing mode, the electronic sound producing mode, a recording mode and a playback mode, and the recording mode and the playback mode are instructed by a player through a mode shift switch corresponding to the mode shift switch 2a. However, the structure of the keyboard instruments, the sequences of the mechanical and electronic sound producing modes are similar to those of the first embodiment, and no further description is incorporated hereinbelow. The reference signs in the following description designate components of the keyboard instrument implementing the first embodiment.

Figure 8:
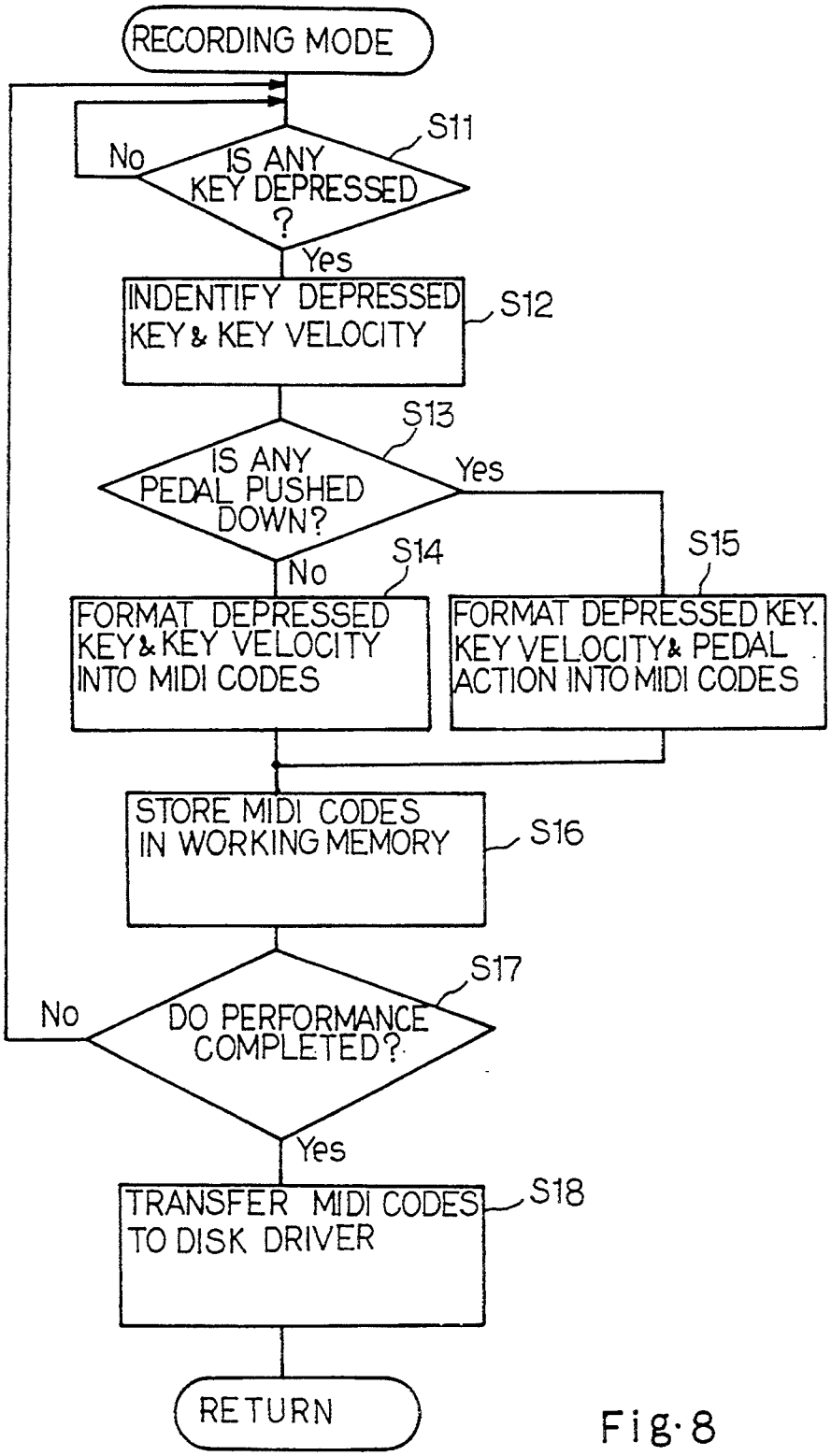
FIG. 8 is a flow chart showing a program sequence executed in a recording mode by yet another keyboard instrument according to the present invention.

If the player instructs the keyboard instrument to enter the recording mode, the supervisor executes a program sequence illustrated in FIG. 8 of the drawings. Upon entry into the recording mode of operation, the supervisor 3k checks the input port assigned to the detecting signals from the key sensors 3b, to see whether or not one of the key sensors reports a key motion as by step S11. If the answer to the step S11 is given negative, the supervisor 3k repeats the step S11 until the player depresses one of the keys 1g.

If the player starts a performance, the key sensors 3b, detects the key motion, and reports it through the detecting signal. Then, the answer to the step S11 is given affirmative, and the supervisor 3k identifies the depressed key and the key velocity as by step S12.

The supervisor 3k proceeds to step S13, and checks the input port assigned to the detecting signals from the pedal sensors 3c to see whether or not any one of the pedals is manipulated. If the answer to the step S13 is given negative, the supervisor 3k formats the depressed key and the key velocity into MIDI (Musical Instrument Digital Interface) codes as by step S14. According to the MIDI standards, the note-on and the key velocity is assigned the status data.

However, if the answer to the step S13 is given affirmative, the player depresses the key under manipulation of one of the pedals, and the supervisor 3k formats the depressed key, the key velocity and the pedal action into MIDI codes as by step S15. According to the MIDI standards, the pedal action is assigned to the first data byte.

When the supervisor 3k completes either step S14 or S15, the supervisor 3k transfers the MIDI codes into the working memory 3r, and the MIDI codes are stored therein as by step S16. Then, the supervisor 3k checks the input ports to see whether or not the player has completed the music as by step S17. If the answer to the step S17 is given negative, the supervisor 3k returns to the step S11, and reiterates the loop consisting of the steps S11 to S17 until completion of the music.

If the player has completed the music, the answer to the step S17 is given affirmative, and the supervisor 3k instructs the floppy disk controller 3s to transfer the MIDI codes from the working memory 3r to the floppy disk driver 3t. Then, the MIDI codes are sequentially transferred to the floppy disk driver 3t, and are stored in a floppy disk.

Figure 9:
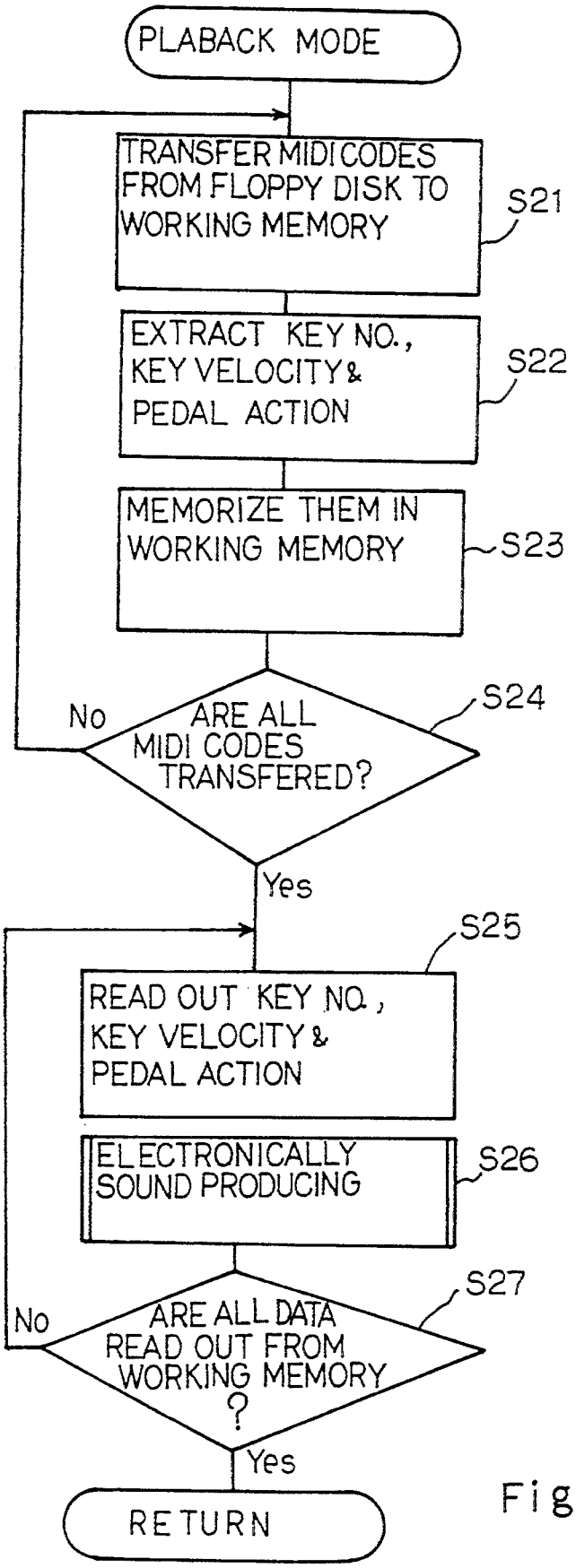
FIG. 9 is a flow chart showing a program sequence executed in a playback mode by the yet another keyboard instrument.

On the other hand, if the player instructs the keyboard instrument to enter the playback mode, the supervisor 3k executes a program sequence illustrated in FIG. 9. Upon entry into the playback mode, the supervisor 3k instructs the floppy disk controller 3s to transfer an MIDI code or MIDI codes from a floppy disk to the working memory 3r as by step S21. The supervisor 3k reads out the MIDI code or codes from the working memory 3r, and extracts pieces of musical information regarding the depressed key, the key velocity and the pedal action from the MIDI code or codes as by step S22. The pieces of musical information are memorized in the working memory 3r as by step S23 again.

The supervisor 3k checks the data volume read out from the floppy disk to see whether or not all of the MIDI codes have been transferred as by step S24. If the answer to the step S24 is given negative, the supervisor 3k returns to the step S21, and reiterates the loop consisting of the steps S21 to S24 until all of the MIDI codes are read out from the floppy disk.

When all of the MIDI codes are read out, the answer to the step S24 is given affirmative, and the supervisor 3k reads out the first pieces of musical information from the working memory 3r. The pieces of musical information are used in the electronic sound producing sub-routine S26 similar to the sub-routine program shown in FIG. 5B.

The supervisor 3k proceeds to step S27, and checks the working memory 3r to see whether or not all of the pieces of musical information are read out therefrom as by step S27 . While the answer is given negative, the supervisor 3k returns to the step S25, and repeats the loop consisting of the steps S25 to S27. However, if the answer to the step S27 is given affirmative, the music is perfectly reproduced, and the supervisor 3k returns to the program sequence shown in FIG. 5A.

Thus, the keyboard instrument implementing the third embodiment records the music performed by a player, and play back music without any keying-in operation on the keyboard.

Fourth Embodiment

Figure 10:
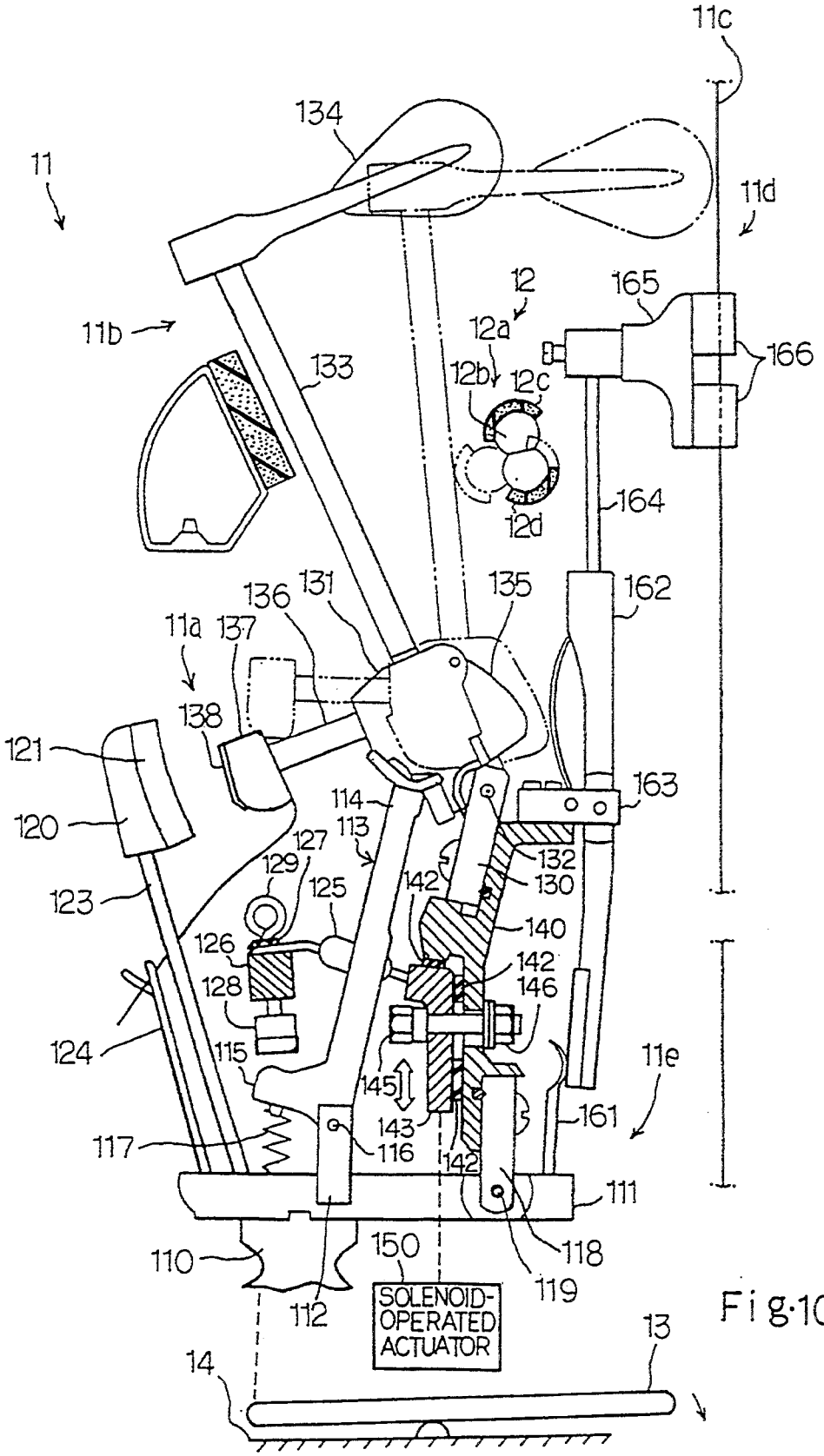
FIG. 10 is partially cut-away side view showing a still another keyboard instrument according to the present invention.

Turning to FIG. 10 of the drawings, a keyboard instrument embodying the present invention largely comprises an upright piano 11, an electronic sound producing system and a controlling system 12. The electronic sound producing system is similar to that of the first embodiment, and is not illustrated in FIG. 10.

The upright piano 11 comprises a keyboard having keys 13 swingable with respect to a key bed 14, a plurality of key action mechanisms 11a linked with the keys 13 of the keyboard, a plurality of hammer mechanisms 11b respectively driven by the associated key action mechanisms 11a, a plurality of strings 11c respectively struck by the hammer mechanisms 11b, a plurality of damper mechanisms 11d driven by the key action mechanisms, and a pedal mechanisms (not shown). However, FIG. 10 illustrates a set of key action mechanism, hammer mechanism and damper mechanism associated with one of the strings 11d vertically stretched.

The key action mechanism 11a contains a whippen assembly 11e, and the whippen assembly 11e comprises a whippen heel 110 and a whippen 111 connected with the whippen heel 110, and the whippen heel 110 is held in contact with a capstan button (not shown) projecting from the rear end of each key 13.

The whippen assembly 11e further comprises a jack flange 112 upright from the whippen 111, a jack 113 with a long arm portion 114 and a short arm portion 115, a pin 116 for coupling the jack 113 with the jack flange 112 and a jack spring 117 coupled between the short arm 115 and the whippen 111, and the jack spring 117 urges the jack 113 to rotate around the pin 116 in the clockwise direction.

The whippen assembly 11e further comprises a whippen flange 118 coupled with the whippen 111 by means of a center pin 119, and the whippen flange is bolted to a rail member laterally extending along the keyboard (not shown). Therefore, the whippen flange 118 is stationary with respect to the keyboard, and allows the whippen 111 to rotate around the center pin 119.

The whippen assembly 11e further comprises a back check block 120, a back check felt 121 bonded to the back check block 120, a back check wire 123 projecting from the whippen 111 for supporting the back check block 120 and a bridle wire 124 also projecting from the whippen 111. The back check block 120 to the bridle wire 124 will be described hereinlater in connection with the hammer mechanism 11b.

The key action mechanism 11a further comprises a non-deformable regulating bracket 125, a regulating rail 126 bolted to the regulating bracket 125 and a regulating button 128 supported by the regulating rail 126, and the gap between the regulating rail 126 and the regulating button 128 is adjustable with a tool (not shown). The regulating rail 126 laterally extends along the keyboard (not shown), and is shared between all of the key action mechanisms 11*a*. When the key 13 is depressed, the short arm portion 115 is brought into contact with the regulating button 128, and the action of the hammer mechanism 11*b* is regulable by changing the gap between the regulating button and the short arm portion 115.

The hammer mechanism 11*b* comprises a butt flange 130, a butt 131 rotatably supported by the butt flange 130 by means of a center pin 132, a hammer shank 133 projecting from the butt 131, a hammer head 134 supported by the hammer shank 133 and a butt spring 135, and the butt spring urges the butt 131 to rotate in the counter clockwise direction.

The hammer mechanism 11*b* further comprises a catcher shank 136 projecting from the butt 131, a catcher 137 supported by the catcher shank 136 and a catcher skin 138 bonded to the catcher 137.

The butt flange 130 is bolted to a first center rail 140, and the first center rail 140 laterally extends along the keyboard. Though not shown in the drawings, the first center rail 140 is connected with a piano case (not shown), and is stationary with respect to the keyboard (not shown).

Figure 11:
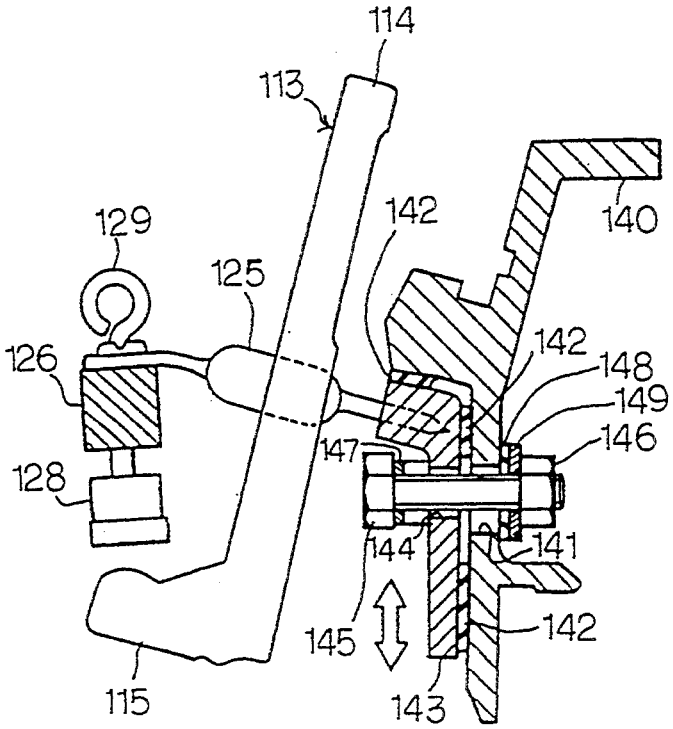
FIG. 11 is a partially cut-away side view showing first and second center rails incorporated in the keyboard instrument shown in FIG. 10.
Figure 12:
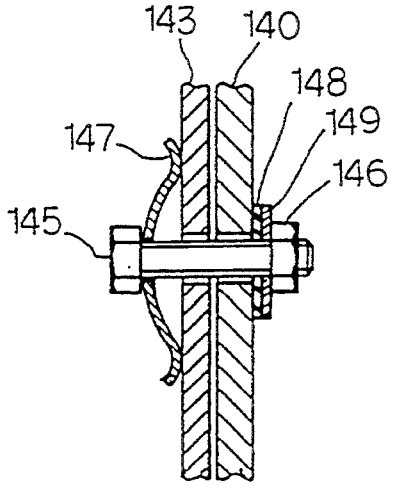
FIG. 12 is a cross sectional view showing the first and second center rails at different angle.
Figure 13:
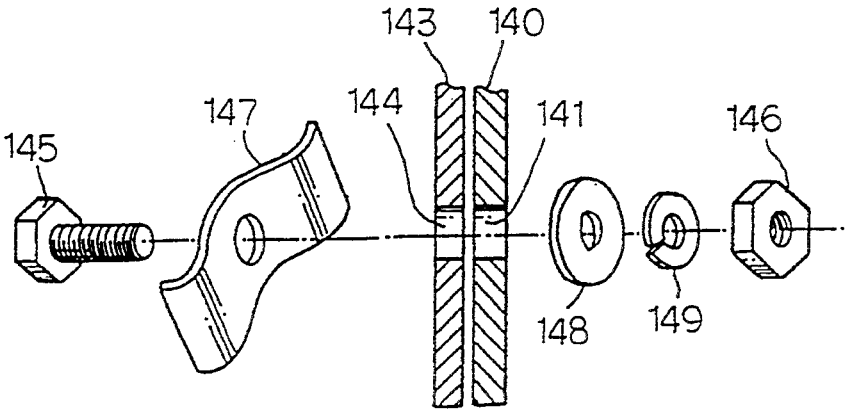
FIG. 13 is a view showing the first and second center rails in a disassembled state.

As will be better seen in FIGS. 11 to 13, an elongated hole 141 is formed in the first center rail 140, and a second center rail 143 is slidably engaged with the first center rail 140. Lubricative sheets 142 are bonded to a second center rail 143, and the second center rail 143 is slidably engaged with the first center rail 140. In this instance, the lubricative sheets 142 is formed of fluorocarbon resin. Namely, a hole 144 is formed in the second center rail 143, and a bolt 145 passes through the hole 144 and the elongated hole 141, and is screwed into a nut 146. A leaf spring 147 is inserted between the second center rail 143 and the bolt 145, and the second center rail 143 and, accordingly, the lubricative sheets 142 are slightly pressed on the first center rail 140. In order to allow the bolt 145 to slide together with the second center rail 143, a lubricative sheet 148 is bonded to a spring washer 149, and the spring washer 149 is inserted between the first center rail 140 and the nut 146.

Turning back to FIG. 10, the second center rail 143 also laterally extends along the keyboard, and the first and second center rails are shared between all of the key action mechanisms 11*a*. The whippen flange 118 is bolted to the first center rail 140, and is also stationary with respect to the keyboard. Therefore, the whippen 111 is swingable with respect to the center pin 119 and, accordingly, to the keyboard. The regulating bracket 125 is screwed into the second center rail 143, and the leading end portion of each regulating bracket 125 is slightly bent toward the whippen 111.

A solenoid-operated actuator 150 is coupled with the second center rail 143, and the plunger of the actuator 150 projected and retracted depending upon an associated switching unit (not shown). As described hereinbefore, the second center rail 143 is slidable with respect to the first center rail 140, and the regulating button 128 is movable together with the second center rail 143. For this reason, while the solenoid-operated actuator 150 projects the plunger thereof, the second center rail 143 is upwardly moved to a spaced position where the lubricative sheet 142 on the top surface of the second center rail 143 is brought into contact with the first center rail 140 as shown in FIG. 10. Then, the gap between the regulating button 128 and the short arm portion 115 is increased. On the other hand, if the solenoid-operated actuator 150 retracts the plunger thereof, the second center rail 143 is downwardly moved to a close position, and the regulating button 128 becomes closer to the short arm portion 115. The gap is variable by 1 millimeter between the spaced position and the closer position. In this instance, while the keyboard instrument is staying in the mechanical sound producing mode, the regulating button 128 is shifted to the spaced position. However, if the keyboard instrument enters the electronical sound producing mode, the regulating button 128 is moved to the closer position, and restricts the motion of the jack 113. In this instance, the solenoid-operated actuator 150 serves as a driver unit.

The damper mechanism 11*d* comprises a damper spoon 161 projecting from the whippen 111, a damper lever 162 turnably supported by a damper lever flange 163, a damper wire 164 projecting from the damper lever 162, a damper wood 165 supported by the damper wire 164 and a damper felt 166 attached to the damper wood 165, and the damper lever flange 163 is connected to the first center rail 140. The damper spoon 161 urges the damper lever 162 to rotate in the counter clockwise direction when the associated key 13 is depressed. Then, the damper felt 166 separates from the string 11*c*, and is brought into contact with the string 11*c* again when the player releases the key 13.

The controlling system 12 is similar to that of the first embodiment, and a rotatable stopper 12*a* is incorporated in the controlling system 12. The rotatable stopper 12*a* comprises a bracket 12*b* and cushion members 12*c* and 12*d*, and is moved by a motor unit (not shown) between the free position indicated by real lines and the blocking position indicated by dots-and-dash lines. While the rotatable stopper 12*a* is in the blocking position, the hammer shank 133 and the damper wire 164 are respectively brought into contact with the cushion members 12*c* and 12*d* when the associated key 13 is depressed. For this reason, the hammer head 134 does not strike the associated string 11*c*, and the electronic sound producing system synthesizes the sound instead of the string 11*c*. However, if the rotatable stopper 12*a* is moved to the free position, the rotatable stopper 12*a* allows the hammer head 134 to strike the string 11*c*, and the string 11*c* vibrates to produce the sound. The rotatable stopper 12*a* is shared between all of the hammer mechanisms 11*b*, and is located in the space between the hammer shanks 133 and the damper wires 164.

Description is hereinbelow made on the behavior of the key action mechanism 11*a* in the mechanical and electronic sound producing modes.

Assuming that the keyboard instrument enters the electronic sound producing mode, the rotatable stopper 12*a* is moved to the blocking position, and the solenoid-operated actuator 150 pulls the second center rail 143 down. Then, the regulating button 128 enters the closer position, and the gap between the regulating button 128 and the short arm portion 115 is decreased. When the player depresses the key 13, the capstan button (not shown) lifts the whippen heel 110 and, accordingly, the whippen 111, and the whippen 111 also lifts the jack 113. While the capstan button is lifting the whippen 111, the whippen 111 rotates around the center pin 119 in the clockwise direction, and the damper spoon 161 pushes the damper lever 162 in the counter clockwise direction. For this reason, the damper lever 162 causes the damper felt 166 to separate from the string 11*c*.

While the whippen 111 is lifting the jack 113, the butt 131 is rotating around the center pin 132 in the clockwise direction, and the hammer shank 133 and the hammer head 134 is also rotating in the clockwise direction. However, the regulating button 128 has been already moved to the closer position, and the short arm position 115 is brought into the regulating button 128 earlier than the mechanically sound producing mode. Then, the jack 113 kicks the butt 131, and the hammer shank 133 and the hammer head 134 rush toward the string 11*c*. In this instance, when the jack 113 kicks the butt 131, the distance between the leading end of the hammer head 134 and the string 11*c* ranges between 5 millimeters and 7 millimeters. Even though the hammer shank 133 and the hammer head 134 rush toward the string 11*c*, the hammer shank 133 is brought into contact with the cushion member 12*c*, and the hammer head 134 is stopped immediately before striking the string 11*c*. The butt spring 135 urges the butt 131 to rotate in the counter clockwise direction, and the catcher skin 138 is brought into contact with the back check felt 121.

Thus, the rotatable stopper 12*a* prevents the string 11*c* from being contacted by the hammer head 134, and the string 11*c* does not vibrate. However, the electronic sound producing system synthesizes the sound with a pitch corresponding to vibrations produced on the string 11*c*.

On the other hand, if the keyboard instrument is changed to the mechanical sound producing mode, the rotatable stopper 12*a* is changed to the free position, and the solenoid-operated actuator 150 lifts the second center rail 143 with respect to the first center rail 140. While sliding upwardly, the lubricative sheets 142 prevent the second center rail 143 from undesirable friction. The second center rail 143 causes the regulating button 128 to enter the closer position, and the gap is decreased by about 1 millimeter. In this situation, when the player depresses the key 13, the damper felt 166 leaves from the string 11*c*, and the short arm portion 115 is brought into contact with the regulating button 128 when the distance between the hammer head 134 and the string 11*c* becomes about 2 millimeters. The jack 113 kicks the butt 131, and the hammer head 134 rushes over the distance and strikes the string 11*c* without any contact with the rotatable stopper 12*a*. The hammer mechanism 11*b* behaves as similar to that in the electronic sound producing mode after striking the string 11*c*.

Thus, the gap between the regulating button 128 and the short arm portion 115 is variable depending upon the mode of operation, and the hammer mechanism rushes toward the string 11*c* at different timings between the mechanical sound producing mode and the electronic sound producing mode. This feature is desirable for the player, because a good piano touch is given to the player without sacrifice of the key action. In detail, if the distance is regulated to an ordinary value of a piano, the hammer shank 133 is brought into contact with the rotatable stopper 12*a* in the electronic sound producing mode before the jack 113 kicks the butt 131. Such an early contact degrades the key-touch. On the other hand, if the distance between the hammer head 134 and the string 11*c* is adjusted to a larger value than that of the ordinary piano, the good piano key-touch may be given to the player. However, such a large distance can not impart sufficiently large energy to the hammer mechanism 11*b*, and the hammer head 134 strikes the string 11*c* with small impact. This results, in a poor return action, and the player can not repeat keying-in at high speed. Moreover, the soft impact changes the timbre, and only soft sounds are produced by the keyboard instrument. However, the regulating button 128 in the closer position allows the jack 113 to kick the butt 131 at the early timing before the hammer shank 133 is brought into contact with the rotatable stopper 12*a*, and a good piano key-touch is given to the player, and quick key action is supported by the regulating button 128 in the spaced position.

Fifth Embodiment

Figure 14:
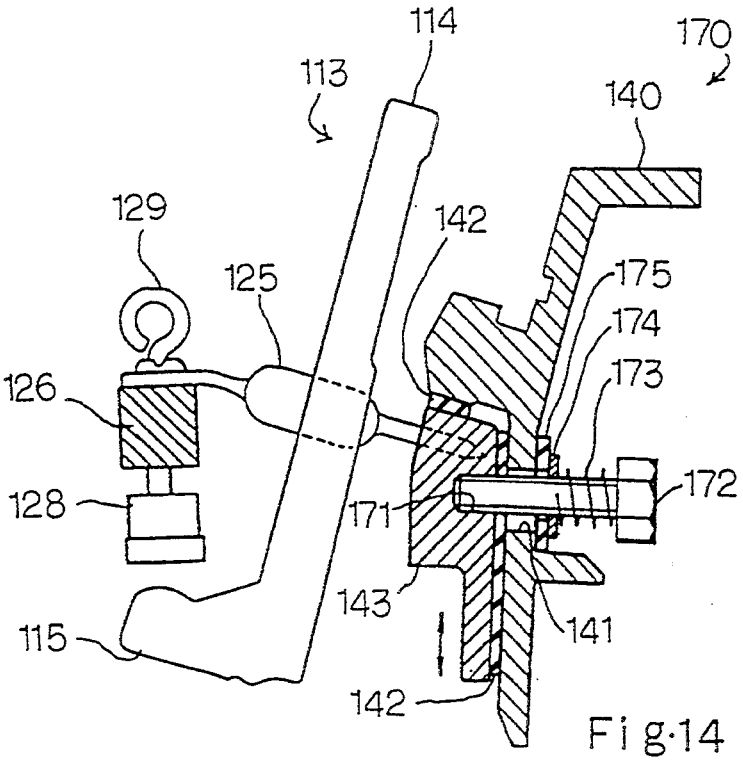
FIG. 14 is a partially cut-away view showing another gap regulating mechanism incorporated in a keyboard instrument according to the present invention.

Turning to FIG. 14 of the drawings, a gap regulating mechanism 170 is incorporated in a keyboard instrument embodying the present invention, and the keyboard instrument implementing the fifth embodiment is similar to the fourth embodiment except for the gap regulating mechanism. For this reason, description is focused on the gap regulating mechanism 170 only, the same references designate corresponding components to the fourth embodiment.

The second center rail 143 is thicker than that of the fourth embodiment, and a threaded hole 171 is formed therein. A bolt 172 passes through the elongated hole 141, and is screwed into the threaded hole 171. A coil spring 173, a washer 174 and a lubricative sheet 175 of fluorocarbon resin are inserted between the first center rail 140 and the head of the bolt 172, and the second center rail 143 is urged to the first center rail 140.

The second center rail 143 is also coupled with an actuator (now shown), and the actuator changes the regulating button 128 between the closer position and the spaced position as similar to the solenoid-operated actuator 150. For this reason, the fifth embodiment achieves the same advantages as the fourth embodiment.

Figure 15:
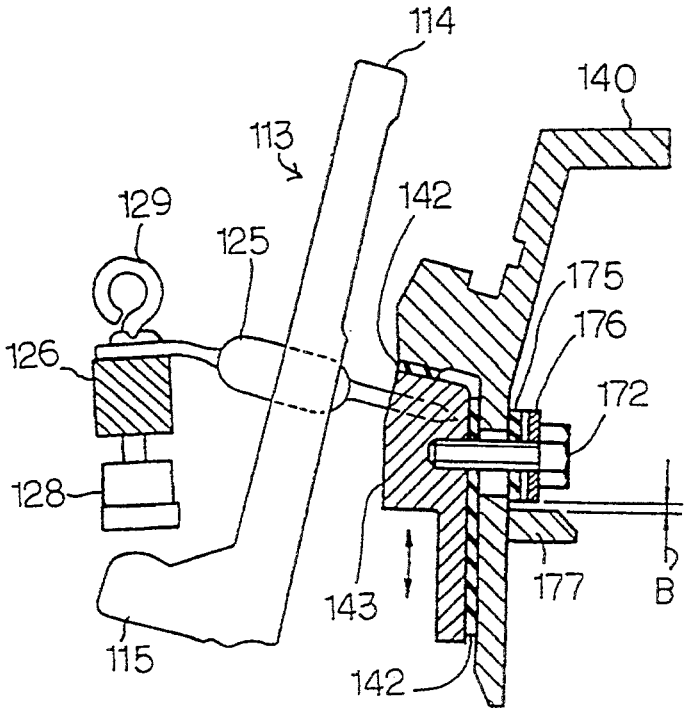
FIG. 15 is a partially cut-away side view showing a modification of the gap regulating mechanism according to the present invention.
Figure 16:
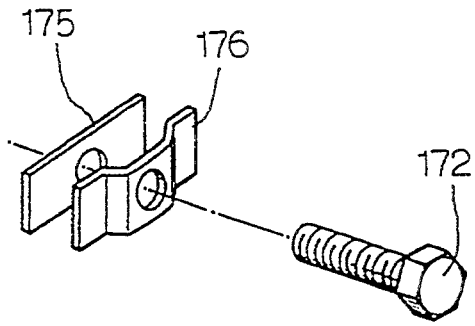
FIG. 16 is a view showing an essential part of the gap regulating mechanism shown in FIG. 15 in a disassembled state.

The coil spring 173 may be replaced with a leaf spring 176 as shown in FIGS. 15 and 16, and the moving distance of the second center rail 143 may be defined by a gap B between the leaf spring 176 and a portion 177 of the first center rail 140 where the whippen flange is fixed.

Sixth Embodiment

Figure 17A:
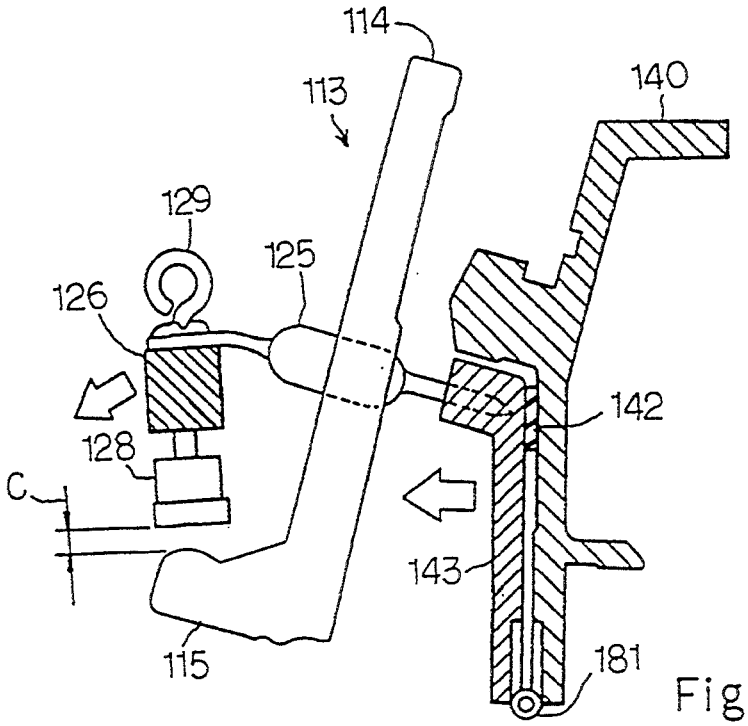
FIGS. 17A and 17B are partially cut-away side views showing yet another gap regulating mechanism incorporated in a keyboard instrument according to the present invention.
Figure 17B:
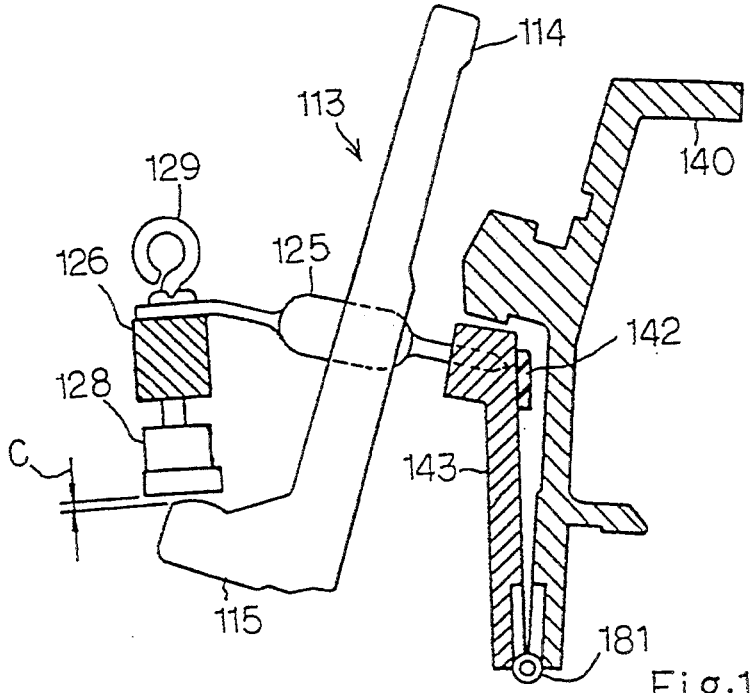

Turning to FIGS. 17A and 17B of the drawings, yet another gap regulating mechanism is incorporated in a keyboard instrument according to the present invention, and the keyboard instrument implementing the sixth embodiment is similar to the fourth embodiment except for the gap regulating mechanism. For this reason, description is focused on the gap regulating mechanism only, the same references designate corresponding components to the fourth embodiment.

The gap regulating mechanism shown in FIGS. 17A and 17B is implemented by a hinge 181, and an actuator (not shown) is coupled with the second center rail 143. While the actuator urges the second center rail 143 toward the first center rail 140, the lubricative sheet 142 attached to the second center rail 143 is held in contact with the first center rail 140, and the gap C between the regulating button 128 and the jack 113 is relatively small as shown in FIG. 17A. However, if the actuator allows the second center rail 143 to leave from the first center rail 140, the gap C is decreased by 1 millimeter as shown in FIG. 17B.

Thus, the gap C is changeable , and all the advantages of the fourth embodiment are achieved by the sixth embodiment.

Figure 18:
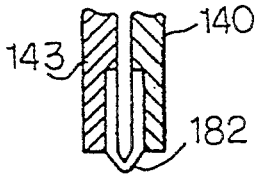
FIG. 18 is a cross sectional view showing a plastic coupling incorporated in a modification of the yet another gap regulating mechanism.

The hinge 181 may be replaced with a plastic hinge 182 as shown in FIG. 18.

Seventh Embodiment

Figure 19A:
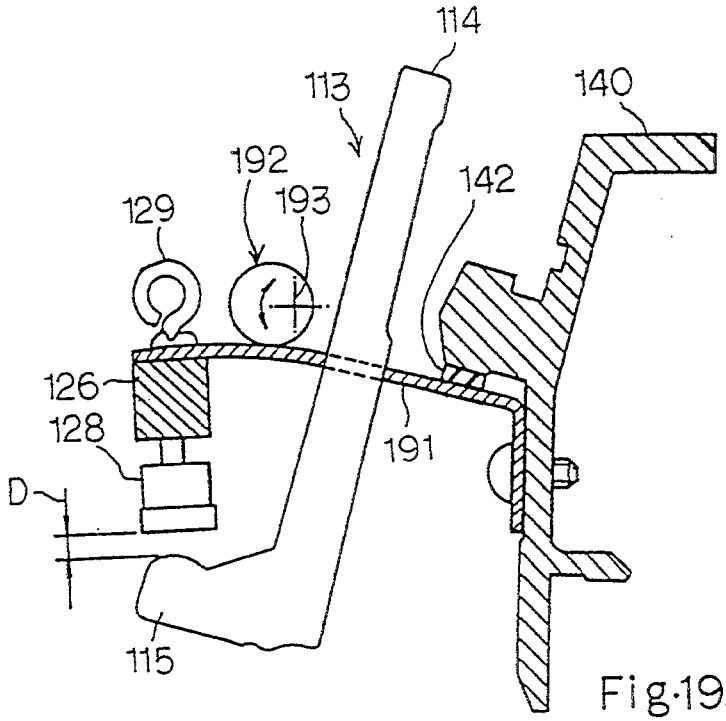
FIGS. 19A and 19B are partially cut-away side views showing a gap regulating mechanism incorporated in a keyboard instrument according to the present invention.
Figure 19B:
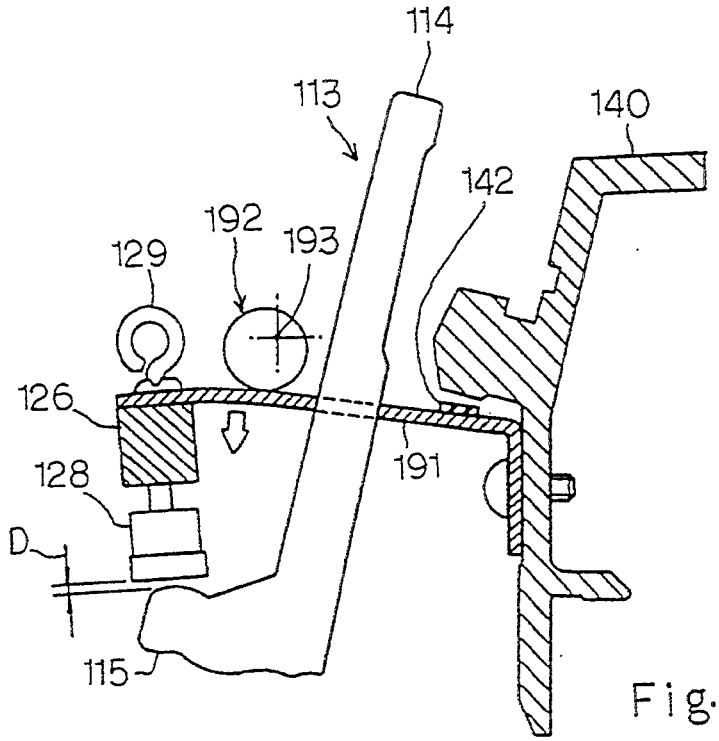

Turning to FIGS. 19A and 19B of the drawings, a gap regulating mechanism is incorporated in a keyboard instrument according to the present invention, and the keyboard instrument implementing the seventh embodiment is similar to the fourth embodiment except for a regulating bracket and the gap regulating mechanism. For this reason, description is focused on the gap regulating mechanism only, the same references designate corresponding components to the fourth embodiment.

The regulating bracket 191 is resiliently deformable , and is directly bolted to the first center rail 140. Any second center rail is incorporated in the keyboard instrument. The gap regulating mechanism is implemented by an eccentric cam member 192 with an eccentric rotational axis 193, and the eccentric cam member 192 is coupled with an actuator (now shown). The distance between the eccentric rotational axis 193 and the regulating bracket 191 is variable depending upon the angular position of the eccentric cam member 192. For example , while the eccentric cam member 192 is held in contact with the regulating bracket 191 at a minor axis, the retortion force of the regulating bracket 191 pulls up the regulating button 192, and the regulating button 128 is spaced apart from the short arm portion 115 as shown in FIG. 19A. The gap between the regulating button 128 and the short arm portion 115 is adjusted to a proper value for the mechanical sound producing mode.

However, if the eccentric cam member 192 is driven for rotation over a predetermined angle , the eccentric cam member 192 becomes held in contact with the regulating bracket 191 at a major axis as shown in FIG. 19B, and the regulating button 128 is pushed down toward the short arm portion 115. Thus, the gap D between the regulating button 128 and the short arm portion 115 varies depending upon the angular position of the eccentric cam member 192, and the variation of the gap D is about 1 millimeter in this instance.

Additionally, an oval cam member is available instead of the eccentric cam member.

The seventh embodiment similarly achieves the same advantages as the fourth embodiment.

Eighth Embodiment

Figure 20:
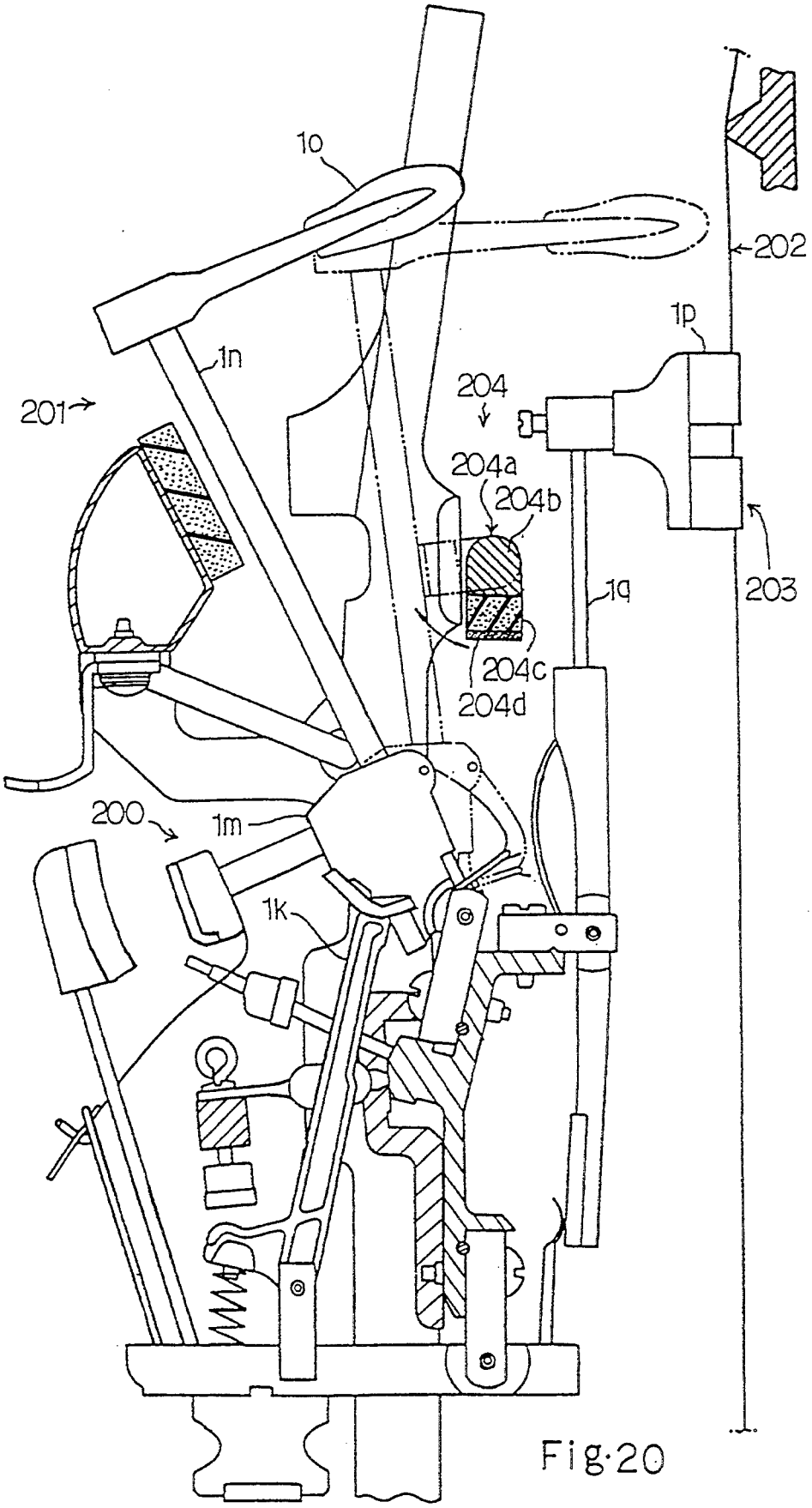
FIG. 20 is a partially cut-away side view showing the structure of an essential part of a keyboard instrument according to the present invention.

Turning to FIG. 20 of the drawings, an essential part of a keyboard instrument embodying the present invention is illustrated. The keyboard instrument implementing the eighth embodiment largely comprises a keyboard (not shown), a plurality of key action mechanisms 200 selectively driven by depressed keys of the keyboard, a plurality of hammer mechanisms 201 coupled with the plurality of key action mechanisms 210, respectively, a plurality sets of music wires 202 respectively associated with the plurality of hammer mechanisms 201, a plurality of damper mechanisms 203 respectively associated with the plurality sets of music wires 202 and a muting system 204 located between the plurality of hammer mechanisms 201 and the plurality sets of musical wires 202. The key action mechanisms 200, the hammer mechanisms 201 and the damper mechanisms 203 are similar to those of the first embodiment, and components parts thereof are labeled with the same references designating corresponding parts of the first embodiment without any detailed description for the same of simplicity.

The muting system 204 comprises a shank stopper 204*a*, and may form a part of a controlling system as similar to the first embodiment. The muting system 204 is snared between all of the hammer mechanisms, and has a shank stopper 204*a* implemented by a laminated structure of a shaft member 204*b*, a cushion member 204*c*, of felt or excenu and a protective sheet 204*d*, of artificial leather. The shaft member 204*b* is coupled with a motor unit (not shown), and a player can instruct the motor unit to drive the shaft member 204*b* through a switching unit (not shown) coupled with one of a hand-operated lever or a foot lever.

If the player requests the muting system 204 to block the hammer shanks 1*n*, the shaft member 204*a* rotates in the clockwise direction over a predetermined angle, and enters the blocking position indicated by dots-and-dash lines. In the blocking position, the protective sheet 204*d*, is opposed to the hammer shanks 1*n*, and the distance between the hammer shanks 1*n* and the protective sheet 204*d*, becomes smaller than the distance between the hammer heads 1*o* and the sets of music wires 202. Under the circumstances, when the player depressed the keys, the hammer shanks 1*n* are brought into contact with the protective sheet 204*d*, before the hammer heads 1*o* strike the associated music wires 202. As a result, the player can practice the fingerings on the keyboard without sounds, and does not disturb his or her neighborhood. The impact of the hammer shank 1*n* is taken up by the cushion member 204*c*, and the protective sheet 204*d*, prolongs the service life of the cushion member 204*c*.

If an electronic sound producing system is incorporated as similar to the first embodiment, the player enjoys the music through a speaker system or a headphone unit. Moreover, if the shank stopper 204*a* is kept at an intermediate angular position between the free position and the blocking position, the hammer shanks 1*n* and the hammer heads 1*o* strike the shank stopper 204*a* and the music wires 202, respectively, and the player performs a music with soft sounds. Finally, if the cushion member 204*c*, is formed of a softer substance, the shank stopper 204*a* allows the hammer heads 1*o* to softly strike the music wires 202 in the blocking position.

On the other hand, if the player instructs the muting system 204 to allow the hammer heads 1*o* to strike the music wires 203, the motor unit drives the shaft member 204*b* in the counter clockwise direction, and the shank stopper 204*a* enters the free position indicated by real lines. The distance between the hammer shanks 1*n* and the shank stopper 204*a* becomes larger than the distance between the hammer heads 1*o* and the music wires 202. In this situation, when the player depresses the keys, the hammer heads 1*o* strike the associated music wires 202, and the music wires vibrate for producing sounds.

If the player is slowly depressing a key, the jack 1*k* upwardly pushes the butt 1*m*, and the hammer shank In is brought into contact with the protective sheet 204*d*. After the contact with the protective sheet 204*d*, the jack 1*k* kicks the butt 1*m*, and is released therefrom. Upon release, the jack 1*k* gives the player an after-touch of a grand piano, and the muting system 204 according to the present invention can simulate the after-touch of the grand piano.

Ninth Embodiment

Figure 21:
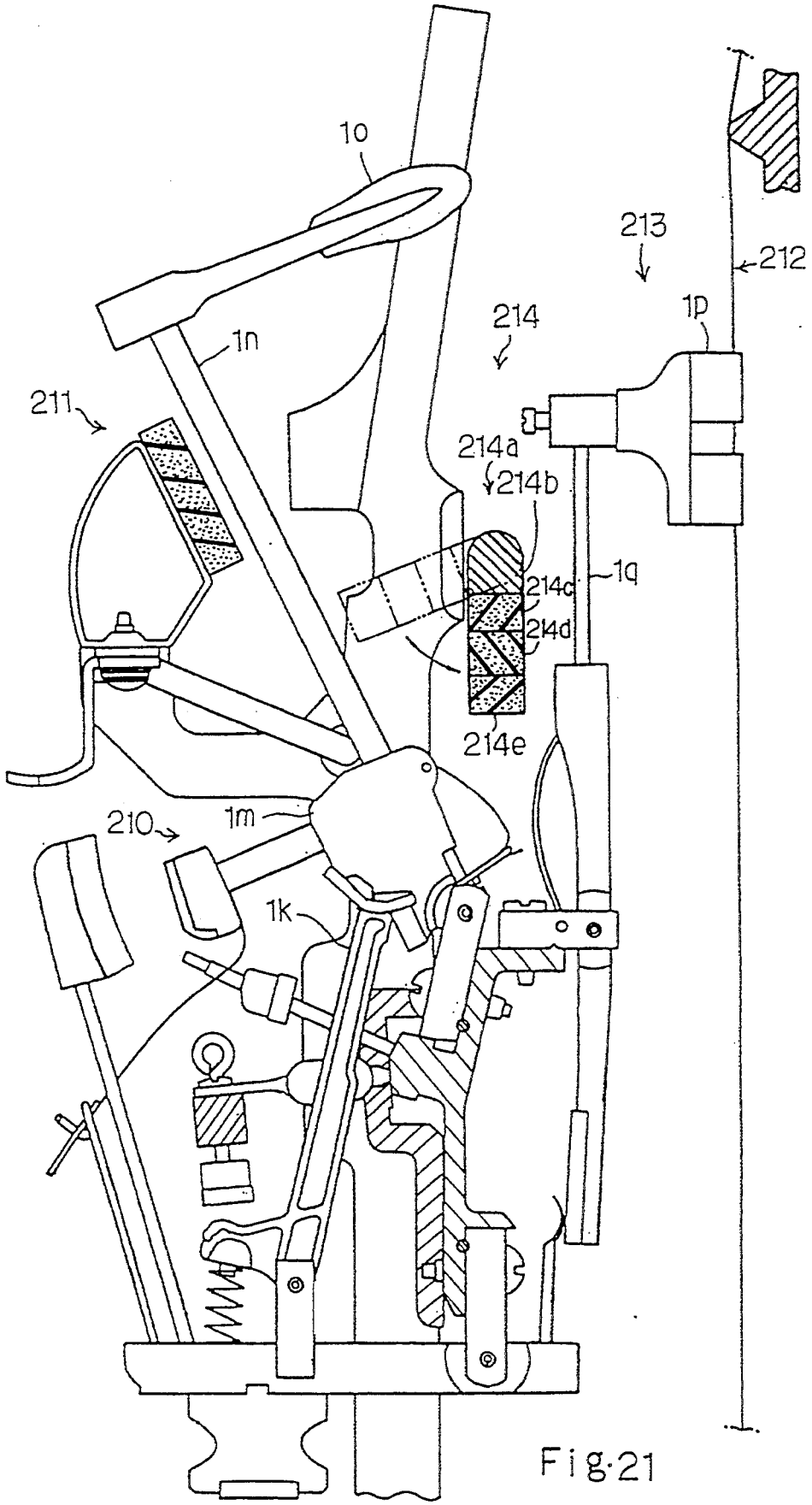
FIG. 21 is a partially cut-away side view showing the structure of an essential part of a keyboard instrument according to the present invention.

Turning to FIG. 21 of the drawings, an essential part of a keyboard instrument embodying the present invention is illustrated. The keyboard instrument implementing the ninth embodiment largely comprises a keyboard (not shown), a plurality of key action mechanisms 210 selectively driven by depressed keys of the keyboard, a plurality of hammer mechanisms 211 coupled with the plurality of key action mechanisms 210, respectively, a plurality sets of music wires 212 respectively associated with the plurality of hammer mechanisms 211, a plurality of damper mechanisms 213 respectively associated with the plurality sets of music wires 212 and a muting system 214 located between the plurality of hammer mechanisms 211 and the plurality sets of musical wires 212. The key action mechanisms 210, the hammer mechanisms 211 and the damper mechanisms 213 are similar to those of the first embodiment, and components parts thereof are labeled with the same references designating corresponding parts of the first embodiment without any detailed description for the same of simplicity.

The muting system 214 comprises a shank stopper 214*a*, and may form a part of a controlling system as similar to the first embodiment. The muting system 214*a* is shared between all of the hammer mechanisms 211, and has a shank stopper 214*a* implemented by a laminated structure of a shaft member 214*b*, a hard cushion member 214*c*, a soft cushion member 214*d* and a softest cushion sheet 214*e*. The shaft member 214*b* is coupled with a motor unit (not shown), and a player can instruct the motor unit to drive the shaft member 214*b* through a switching unit (not shown) coupled with one of a hand-operated lever or a foot lever. The total volume of the hard, soft and softest cushion members 214*c* to 214*e* is approximately equal to the volume of the cushion member 204*c*, of the ninth embodiment. The soft cushion member 214*d* is larger in resiliency than the hard cushion member 214*c* and smaller than the softest cushion member 214*e*.

If the player requests the muting system 214 to block the hammer shanks 1*n*, the shaft member 214*a* rotates in the clockwise direction over a predetermined angle , and enters the blocking position indicated by dots-and-dash lines. In the blocking position, the softest cushion member 214*e* is opposed to the hammer shanks 1*n*, and the distance between the hammer shanks 1*n* and the softest cushion member 214*e* becomes smaller than the distance between the hammer heads 1*o* and the sets of music wires 212. Under the circumstances, when the player depressed the keys, the hammer shanks 1*n* are brought into contact with the softest cushion member 214*e* before the hammer heads 1*o* strike the associated music wires 212. As a result, the player can practice the fingerings on the keyboard without sounds, and does not disturb his or her neighborhood. The impact of the hammer shank In is taken up by the cushion members 214*c* to 214*e*, and impact noises are further decreased by the laminated structure, because the hammer shanks 1*n* gradually stop.

On the other hand, if the player instructs the muting system 214 to allow the hammer heads 1*o* to strike the music wires 212, the motor unit drives the shaft member 214*b* in the counter clockwise direction, and the shank stopper 214*a* enters the free position indicated by real lines. The distance between the hammer shanks 1*n* and the shank stopper 214*a* becomes larger than the distance between the hammer heads 1*o* and the music wires 212. In this situation, when the player depresses the keys, the hammer heads 1*o* strike the associated music wires 212, and the music wires vibrate for producing sounds.

In this instance, the laminated structure has the three cushion members 214*c* to 214*e*. However, another laminated structure may be implemented by more than three levels. Moreover, resiliency may be increased from the cushion member 214*e* to the cushion member 214*c*.

Tenth Embodiment

Figure 22:
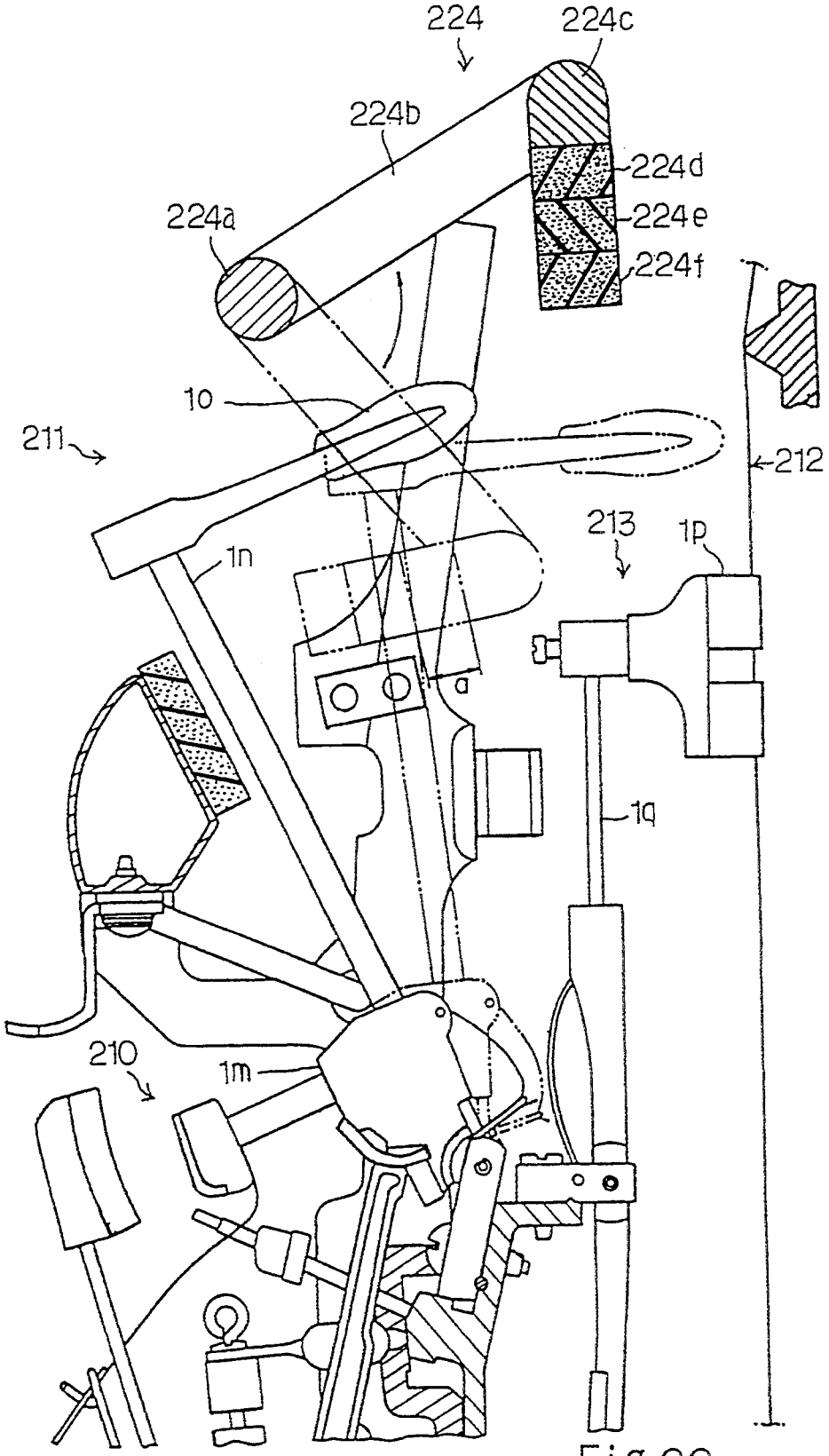
FIG. 22 is a partially cut-away side view showing the structure of an essential part of a keyboard instrument according to the present invention.

Turning to FIG. 22 of the drawings, an essential part of a keyboard instrument embodying the present invention is provided with a muting mechanism 224. However, the other components parts are similar to those of the ninth embodiment, and the corresponding component parts are labeled with the same references without any description for avoiding undesirable repetition.

The muting mechanism 224 comprises a shank stopper which in turn includes a shaft member 224*a*, a link member 224*b*, a bracket member 224*c* and a laminated structure implemented by three cushion members 224*d*, 224*e* and 224*f*. Though not shown in the drawings, the shaft member 224*a* is coupled with a motor unit, and the shank stopper is changed between a free position indicated by real lines and a blocking position indicated by dots-and-dash lines.

If a player requests the muting system 224 to block the hammer shanks 1*n*, the shaft member 214*a* rotates in the clockwise direction over a predetermined angle , and enters the blocking position. In the blocking position, the cushion member 224*f* is opposed to the hammer shanks 1*n*, and the distance between the hammer shanks 1*n* and the cushion member 224*f* becomes smaller than the distance between the hammer heads 1*o* and the sets of music wires 212. When the player depressed the keys, the hammer shanks 1*n* are brought into contact with the cushion member 224*f*, and shrinks the cushion members 224*f* to 224*d*, to the length indicated by "a". Even if the cushion members 224*f* to 224*d*, are shrunk, the hammer heads 1*o* do not strike the associated music wires 212, and impact noises are eliminated. As a result, the player can practice the fingerings on the keyboard without sounds, and does not disturb his neighborhood.

On the other hand, if the player instructs the muting system 224 to allow the hammer heads 1*o* to strike the music wires 212, the motor unit drives the shaft member 224*a* in the counter clockwise direction, and the shank stopper enters the free position. The shank stopper is moved outside of the trajectory of the hammer shanks 1*n* and the hammer heads 1*o*. In this situation, when the player depresses the keys, the hammer heads 1*o* strike the associated music wires 212, and the music wires vibrate for producing sounds.

Eleventh Embodiment

Figure 23:
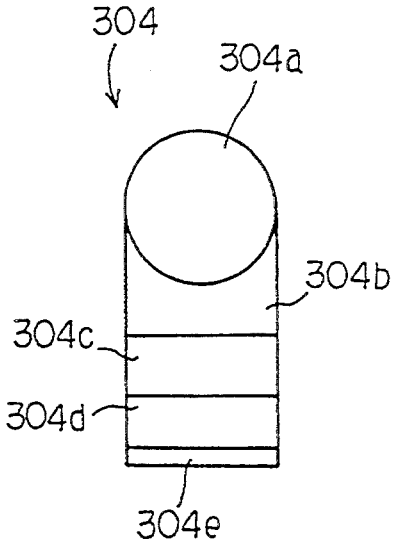
FIG. 23 is a front view showing a shank stopper incorporated in a keyboard instrument according to the present invention.

Turning to FIG. 23 of the drawings, a shank stopper 304 incorporated in a keyboard instrument according to the present invention forms a part of a muting system which in turn forms a part of a controlling system as similar to the first embodiment. The keyboard instrument implementing the eleventh embodiment is similar to the eighth embodiment except for the shank stopper 304, and, for this reason, description is made on the shank stopper 304 only for the sake of simplicity.

The shank stopper 304 comprises a rotational rod 304*a*, a bracket member 304*b* fixed to the rotational rod 304*a* and a laminated structure fixed to the bracket member 304*b*, and the laminated structure is constituted by a relatively hard layer 304*c* bonded to the bracket member 304*b*, a relatively soft layer 304*d* bonded to the relatively hard layer 304*c* and a protective layer 304*e* bonded to the relatively soft layer 304*d*. The bracket member 304*b* is formed of wood or metal, and the relatively hard layer 304c is larger in modulus of elasticity than the relatively soft layer. In this instance, the modulus of elasticity means Young's modulus. The relatively hard layer 304c and the relatively soft layer 304d are, by way of example, formed of Poron H32 and Poron LE20 (trademark), and the protective layer 304e may be of the excenu. Poron H32 and Poron LE20 are of urethane foam, and the urethan foam contains a large number of micro-cells. However, Poron H32 and poron LE20 are different in micro-cell density, and are, accordingly, different in modulus of elasticity.

Thus, the laminated structure is gradually increased in the direction of force exerted thereto. The laminated structure takes up the kinetic energy of the hammer shank, and gradually decelerates the hammer shank and, accordingly, the hammer. The laminated structure effectively takes up impact noises and allows the hammer shank to rebound in a fashion similar to that of an acoustic piano. The shank stopper 304 gives piano-like key-touch to the player.

Table teaches the advantage of the laminated structure.

TABLE

| Specimen | Velocity Ratio Force (kgf) 0.50 pp | 1.00 mp | 1.50 mf | 2.00 f | 2.50 ff | Ratio of Min. Ratio to Max. Ratio (%) | Laminated Structure |
|---|---|---|---|---|---|---|---|
| 1 | 0.59 | 0.70 | 0.73 | 0.78 | 0.74 | 32.2 | Poron LE20 |
| 2 | 0.53 | 0.69 | 0.75 | 0.70 | 0.73 | 39.6 | + |
| 3 | 0.57 | 0.65 | 0.74 | 0.66 | 0.66 | 29.8 | Poron H32 |
| 4 | 0.51 | 0.61 | 0.72 | 0.67 | 0.68 | 41.2 | + |
| 5 | 0.50 | 0.57 | 0.66 | 0.62 | 0.62 | 32.0 | excenu |
| 6 | 0.56 | 0.63 | 0.63 | 0.73 | 0.69 | 30.4 | (11th Emb.) |
| 7 | 0.58 | 0.57 | 0.58 | 0.61 | 0.61 | 6.9 | Poron LE20 + |
| 8 | 0.60 | 0.56 | 0.61 | 0.55 | 0.58 | 10.7 | excenu |
| 9 | about 0.45 | | about 0.65 | | about 0.80 | 77.8 | Mid. Pitch tone of Grand Piano |

In the above Table, specimens 1 to 6 were of the type incorporated in the eleventh embodiment, and each of the stoppers labeled with "7" and "8" was implemented by a relatively soft layer laminated with a protective layer. Specimen 9 was measured in an acoustic grand piano. The abbreviations "pp", "mp", "mf", "f" and "ff" are indicative of pianissimo, mezzo-piano, mezzo-forte" forte and fortissimo, and forces corresponded to these key-touches. Each value under the key-touches was indicative of the ratio between the hammer velocity before striking the shank stopper and the hammer velocity rebounding from the shank stopper.

As will be understood from Table , the velocity ratios of specimens 1 to 6 were increased from the pianissimo to the fortissimo, and such an increasing tendency was similar to the acoustic piano. However, the velocity ratios of each specimen 7 or 8 were constant regardless of the key-touch. Moreover, specimens 1 to 6 were larger in the ratio of the minimum velocity ratio to the maximum velocity ratio than specimens 7 and 8, and were closer to those of the acoustic grand piano. Therefore, the shank stopper 304 effectively gives piano-like key-touches to the player.

Although particular embodiments of the present invention have been shown and described, it will be obvious to those skilled in the art that various changes and modifications may be made without departing from the spirit and scope of the present invention. For example, the present invention is applicable to any keyboard instrument such as, for example , an organ or a harpsichord. Moreover, the key sensor may have a gray scale gradually changing the luminosity instead of the patterned shutter plate for enhancing the accuracy of the detected key velocity, and the key sensors may be implemented by electric switching array. The above described embodiments changes the stoppers between the blocking position and the free position through rotation and vertically straight motion. However another embodiment may changes the stopper between the blocking position and the free position through horizontally straight motion. A keyboard instrument according to the present invention may have not only mechanical and electronic sound producing modes but also either recording or playback mode only. The movable regulating button in the fourth embodiment is available for a standard mechanical-only piano, because trainees may want to practice keying-in without sounds.

What is claimed is:

1. A keyboard instrument selectively providing a mechanical sound producing mode and an electronic sound producing mode, comprising:

a) an acoustic piano including a-1) a keyboard having a plurality of keys turnable with respect to a stationary board member, said plurality of keys being selectively depressed in both mechanical and electronic sound producing modes by a player, a-2) a plurality of key action mechanisms respectively coupled with said plurality of keys, and selectively actuated by said plurality of keys when said player depresses the keys, a-3) a plurality of hammer mechanisms respectively associated with said plurality of key action mechanisms, and having respective hammers and hammer shanks respectively coupled with said hammers and driven for rotation by said plurality of key action mechanisms when said player selectively depresses said plurality of keys, and a-4) a plurality of music wires associated with said plurality of hammer mechanisms, and struck by said hammers in said mechanical sound producing mode when the player selectively depresses said plurality of keys;

b) an electronic sound producing means monitoring said plurality of keys to see what keys are depressed by said player in said electronic sound producing mode, and operative to electronically produce sounds corresponding to the keys depressed by said player; and c) a controlling means having a stopper located between said hammer shanks and said plurality of music wires, and a driver unit for driving said stopper between a free position in the mechanical sound producing mode and a blocking position in the electronic sound producing mode and responsive to an instruction of said player for changing the position of said stopper, said hammers freely striking said music wires without any interruption with said stopper when said stopper is in said free position, said hammer shanks being brought into contact with said stopper when said stopper is in said blocking position so that said hammers are blocked to prevent the hammers from causing vibration of said plurality of music wires.

2. A keyboard instrument as set forth in claim 1, in which said stopper comprises a shaft member having a rotational axis and coupled with said driving unit implemented by a motor, a plurality of bracket members arranged along the rotational axis at intervals and projecting from a predetermined surface of said shaft member, a plurality of cushion members attached to the leading ends of said plurality of bracket members for absorbing impacts of said hammers, and cushion sheets attached to another surface of said shaft member on the opposite side to said predetermined surface, lines of action of said hammer impacts being directed to said rotational axis.

3. A keyboard instrument as set forth in claim 1, in which said hammer shanks are partially implanted into butts, respectively, and said rotatable stopper is located closer to said butts than said hammers.

4. A keyboard instrument as set forth in claim 1, in which said keyboard instrument further has a recording mode for storing pieces of musical information indicative of key motions and pedal motions into a non-volatile recording medium.

5. A keyboard instrument as set forth in claim 1, in which said keyboard instrument further has a playback mode so that said electronic sound producing means reproduces a music from pieces of musical information indicative of key motions and pedal motions stored in a non-volatile recording medium.

6. A keyboard instrument as set forth in claim 1, in which said stopper comprises a plate member having oblique surfaces on one side thereof, a plurality of cushion members attached to said oblique surfaces, and a plurality of cushion sheets attached to the opposite side of said plate member, and in which said driving unit comprises springs from which said plate member is hung, a link mechanism coupled with said plate member for pulling down the plate member, and a pedal manipulated by a player for pulling down said plate member via the link, said stopper entering said blocking position when said plate member is pulled down by said player, said stopper entering said free position when said plate member returns to an initial position by means of said springs.

7. A keyboard instrument as in claim 1 wherein said driver unit moves said stopper between a first point and a second point and can maintain the stopper at any of plural positions between the first and second point, wherein the free position includes the first point and the blocking position includes the second point.

8. A keyboard instrument as set forth in claim 1, in which each of said key action mechanisms includes a whippen assembly driven by said key and having a whippen heel functionally coupled with said key, a whippen fixed to said whippen heel and rotatably supported by a whippen flange fixed to a first center rail stationary with respect to said keyboard, a jack flange fixed to the whippen, a jack rotatably supported by said jack flange, and a jack spring coupled between said whippen and said jack for urging the jack in a direction to decrease a distance therebetween, and a regulating button assembly supported by a second center rail and spaced from said jack for restricting a rotation of said jack, and in which each of said hammer mechanisms further includes a butt rotatably supported by a butt flange fixed to said first center rail, and driven for rotation by said jack at a low speed before said jack is brought into contact with said regulating button assembly, said butt being kicked by said jack for rotation at a high speed when said jack is brought into contact with said regulating button assembly, said hammer shank projecting from said butt, said keyboard instrument further comprising a gap regulating means coupled with said second center rail, and allowing said second center rail to move with respect to said first center rail so as to change a gap between said regulating button assembly and said jack.

9. A keyboard instrument as set forth in claim 8, in which said second center rail is either angularly or slidably movable with respect to said first center rail.

10. A keyboard instrument as set forth in claim 1, in which said stopper comprises a shaft member rotational around a center axis thereof, a bracket means coupled with an outer surface of said shaft member and a multiple-level cushion structure implemented by a plurality of cushion members sequentially laminated, said plurality of cushion members including at least one cushion member different in resiliency from the other cushion members.

11. A keyboard instrument as set forth in claim 10, in which said plurality of cushion members including the uppermost cushion member serving as a protective layer for prolonging the service time of said multiple-level cushion structure.

12. A keyboard instrument as set forth in claim 10, in which said shaft member is located the outside of a trajectory of said hammer mechanisms, and is moved into an inside space of said trajectory for opposing said hammer shanks.

13. A keyboard instrument as set forth in claim 10, in which said plurality of cushion members have an increasing modulus of elasticity from an upper level of said multi-level cushion structure to a lower level of said multi-level cushion structure, said upper level being closer to a struck surface with said hammer than said lower level.

14. A piano comprising a) at least one key swingable with respect to a key bed;

b) a key action mechanism including b-1) a whippen assembly driven by said key and having a whippen heel functionally coupled with said key, a whippen fixed to said whippen heel and rotatably supported by a whippen flange fixed to a first center rail stationary with respect to said key bed, a jack flange fixed to the whippen, a jack rotatably supported by said jack flange, and a jack spring coupled between said whippen and said jack for urging the jack in a direction to decrease a distance therebetween, and b-2) a regulating button assembly supported by a second center rail and spaced from said jack for restricting a rotation of said jack;

c) a hammer mechanism including c-1) a butt rotatably supported by a butt flange fixed to said first center rail, and driven for rotation by said jack at a low speed before said jack is brought into contact with said regulating button assembly, said butt being kicked by said jack for rotation at a high speed when said jack is brought into contact with said regulating button assembly, c-2) a hammer shank projecting from said butt, and c-3) a hammer head fixed to said hammer shank;

d) a string spaced apart from said hammer head while said key is kept in a rest position, said string being struck by said hammer head when said key is depressed;

e) a stopper located between said hammer mechanism and said string, and movable between a free position and a blocking position, said hammer shank being brought into contact with said stopper in said blocking position to prevent said hammer head from imparting vibration to said string, said stopper in said free position allowing said hammer head to strike said string without contact with said hammer shank; and f) a gap regulating means coupled with said second center rail, and allowing said second center rail to move with respect to said first center rail so as to change a gap between said regulating button assembly and said jack.

15. A keyboard instrument comprising:

a plurality of strings which vibrate to produce sound when struck;

a keyboard having a plurality of keys;

a plurality of key action mechanisms coupled to the keys;

a plurality of rotatable hammer and shank mechanisms associated with the key action mechanisms so that depression of a key imparts rotation to an associated hammer and shank mechanism via a key action mechanism to move the hammer toward a string;

a stopper located between the strings and the shanks of the hammer and shank mechanisms and movable between a free position and a blocking position, wherein when the stopper is in the free position the hammers are free to strike the strings to cause them to vibrate and wherein when the stopper is in the blocking position it intercepts the shanks at a point to prevent the hammers from causing vibration of the strings;

means for detecting key depression; and electronic sound producing means for producing sounds electronically corresponding to the depressed keys when the stopper is in the blocking position.

* * * * *